US009208792B2

(12) United States Patent
Rajendran et al.

(10) Patent No.: US 9,208,792 B2
(45) Date of Patent: Dec. 8, 2015

(54) SYSTEMS, METHODS, APPARATUS, AND COMPUTER-READABLE MEDIA FOR NOISE INJECTION

(75) Inventors: Vivek Rajendran, San Diego, CA (US); Ethan Robert Duni, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 218 days.

(21) Appl. No.: 13/211,027

(22) Filed: Aug. 16, 2011

(65) Prior Publication Data

US 2012/0046955 A1 Feb. 23, 2012

Related U.S. Application Data

(60) Provisional application No. 61/374,565, filed on Aug. 17, 2010, provisional application No. 61/384,237, filed on Sep. 17, 2010, provisional application No. 61/470,438, filed on Mar. 31, 2011.

(51) Int. Cl.
*G10L 21/00* (2013.01)
*G10L 25/90* (2013.01)
(Continued)

(52) U.S. Cl.
CPC ..... *G10L 19/028* (2013.01)

(58) Field of Classification Search
CPC ..... G10L 19/02; G10L 19/03; G10L 19/06; G10L 19/012; G10L 19/028; G10L 19/032; G10L 19/035; G10L 19/038; G10L 19/0204; G10L 19/0208; G10L 19/005
USPC ..... 704/500–501, E19.006, 205, 206, 225, 704/226
See application file for complete search history.

(56) References Cited

U.S. PATENT DOCUMENTS 3,978,287 A 8/1976 Fletcher et al.
4,516,258 A 5/1985 Ching et al.
(Continued)

FOREIGN PATENT DOCUMENTS

CN 1207195 A 2/1999
CN 1239368 A 12/1999
(Continued)

OTHER PUBLICATIONS

3GPP TS 26.290 v8.0.0.,"Audio codec processing functions; Extended Adaptive Multi-rate—Wideband (AMR-WB+) codec; Transcoding functions", Release 8, pp. 1-87, (Dec. 2008).
(Continued)

*Primary Examiner* — Eric Yen
(74) *Attorney, Agent, or Firm* — Austin Rapp & Hardman

(57) ABSTRACT

A method of processing an audio signal is described. The method includes selecting one among a plurality of entries of a codebook based on information from the audio signal. The method also includes determining locations, in a frequency domain, of zero-valued elements of a first signal that is based on the selected codebook entry. The method further includes calculating energy of the audio signal at the determined frequency-domain locations. The method additionally includes calculating a value of a measure of a distribution of the energy of the audio signal among the determined frequency-domain locations. The method also includes calculating a noise injection gain factor based on the calculated energy and the calculated value.

31 Claims, 17 Drawing Sheets

(51) Int. Cl.
*G10L 21/02* (2013.01)
*G10L 19/028* (2013.01)

(56) References Cited

U.S. PATENT DOCUMENTS

| | | | | |
|---|---|---|---|---|
| 4,964,166 | A | 10/1990 | Wilson | |
| 5,222,146 | A | 6/1993 | Bahl et al. | |
| 5,309,232 | A | 5/1994 | Hartung et al. | |
| 5,321,793 | A | 6/1994 | Drogo De Iacovo et al. | |
| 5,388,181 | A | 2/1995 | Anderson et al. | |
| 5,479,561 | A | 12/1995 | Kim | |
| 5,630,011 | A | 5/1997 | Lim et al. | |
| 5,664,057 | A * | 9/1997 | Crossman et al. | 704/229 |
| 5,692,102 | A * | 11/1997 | Pan | 704/230 |
| 5,781,888 | A | 7/1998 | Herre | |
| 5,842,160 | A | 11/1998 | Zinser | |
| 5,911,128 | A | 6/1999 | DeJaco | |
| 5,962,102 | A * | 10/1999 | Sheffield et al. | 428/92 |
| 5,978,762 | A | 11/1999 | Smyth et al. | |
| 5,999,897 | A | 12/1999 | Yeldener | |
| 6,035,271 | A | 3/2000 | Chen | |
| 6,058,362 | A | 5/2000 | Malvar | |
| 6,064,954 | A | 5/2000 | Cohen et al. | |
| 6,078,879 | A | 6/2000 | Taori et al. | |
| 6,094,629 | A | 7/2000 | Grabb et al. | |
| 6,098,039 | A | 8/2000 | Nishida | |
| 6,108,623 | A * | 8/2000 | Morel | 704/219 |
| 6,236,960 | B1 | 5/2001 | Peng et al. | |
| 6,246,345 | B1 | 6/2001 | Davidson et al. | |
| 6,301,556 | B1 | 10/2001 | Hagen et al. | |
| 6,308,150 | B1 | 10/2001 | Neo et al. | |
| 6,363,338 | B1 | 3/2002 | Ubale et al. | |
| 6,424,939 | B1 | 7/2002 | Herre et al. | |
| 6,593,872 | B2 | 7/2003 | Makino et al. | |
| 6,766,288 | B1 | 7/2004 | Smith | |
| 6,952,671 | B1 | 10/2005 | Kolesnik et al. | |
| 7,069,212 | B2 | 6/2006 | Tanaka et al. | |
| 7,272,556 | B1 | 9/2007 | Aguilar et al. | |
| 7,310,598 | B1 | 12/2007 | Mikhael et al. | |
| 7,340,394 | B2 | 3/2008 | Chen et al. | |
| 7,447,631 | B2 * | 11/2008 | Truman et al. | 704/230 |
| 7,493,254 | B2 | 2/2009 | Jung et al. | |
| 7,613,607 | B2 | 11/2009 | Valve et al. | |
| 7,660,712 | B2 | 2/2010 | Gao et al. | |
| 7,885,819 | B2 | 2/2011 | Koishida et al. | |
| 7,912,709 | B2 | 3/2011 | Kim | |
| 8,111,176 | B2 | 2/2012 | Tosato et al. | |
| 8,364,471 | B2 * | 1/2013 | Yoon et al. | 704/206 |
| 8,370,133 | B2 * | 2/2013 | Taleb et al. | 704/201 |
| 8,493,244 | B2 | 7/2013 | Satoh et al. | |
| 8,831,933 | B2 | 9/2014 | Duni et al. | |
| 2001/0023396 | A1 | 9/2001 | Gersho et al. | |
| 2002/0161573 | A1 | 10/2002 | Yoshida | |
| 2002/0169599 | A1 | 11/2002 | Suzuki | |
| 2003/0061055 | A1 | 3/2003 | Taori et al. | |
| 2003/0233234 | A1 * | 12/2003 | Truman et al. | 704/256 |
| 2004/0133424 | A1 | 7/2004 | Ealey et al. | |
| 2004/0196770 | A1 | 10/2004 | Touyama et al. | |
| 2005/0080622 | A1 | 4/2005 | Dieterich et al. | |
| 2006/0015329 | A1 | 1/2006 | Chu | |
| 2006/0036435 | A1 | 2/2006 | Kovesi et al. | |
| 2007/0271094 | A1 | 11/2007 | Ashley et al. | |
| 2007/0282603 | A1 | 12/2007 | Bessette | |
| 2007/0299658 | A1 | 12/2007 | Wang et al. | |
| 2008/0027719 | A1 | 1/2008 | Kirshnan et al. | |
| 2008/0040120 | A1 | 2/2008 | Kurniawati et al. | |
| 2008/0052066 | A1 | 2/2008 | Oshikiri et al. | |
| 2008/0059201 | A1 * | 3/2008 | Hsiao | 704/500 |
| 2008/0097757 | A1 | 4/2008 | Vasilache | |
| 2008/0126904 | A1 | 5/2008 | Sung et al. | |
| 2008/0234959 | A1 | 9/2008 | Joublin et al. | |
| 2008/0310328 | A1 * | 12/2008 | Li et al. | 370/269 |
| 2008/0312758 | A1 | 12/2008 | Koishida et al. | |
| 2008/0312759 | A1 * | 12/2008 | Koishida et al. | 700/94 |
| 2008/0312914 | A1 | 12/2008 | Rajendran et al. | |
| 2009/0177466 | A1 | 7/2009 | Rui et al. | |
| 2009/0187409 | A1 * | 7/2009 | Krishnan et al. | 704/262 |
| 2009/0234644 | A1 | 9/2009 | Reznik et al. | |
| 2009/0271204 | A1 | 10/2009 | Tammi | |
| 2009/0299736 | A1 | 12/2009 | Sato | |
| 2009/0319261 | A1 | 12/2009 | Gupta et al. | |
| 2009/0326962 | A1 * | 12/2009 | Chen et al. | 704/500 |
| 2010/0017198 | A1 | 1/2010 | Yamanashi et al. | |
| 2010/0054212 | A1 | 3/2010 | Tang | |
| 2010/0121646 | A1 | 5/2010 | Ragot et al. | |
| 2010/0169081 | A1 | 7/2010 | Yamanashi et al. | |
| 2010/0241437 | A1 * | 9/2010 | Taleb et al. | 704/500 |
| 2010/0280831 | A1 * | 11/2010 | Salami et al. | 704/500 |
| 2011/0173012 | A1 * | 7/2011 | Rettelbach et al. | 704/500 |
| 2011/0178795 | A1 * | 7/2011 | Bayer et al. | 704/205 |
| 2012/0029923 | A1 | 2/2012 | Rajendran et al. | |
| 2012/0029924 | A1 | 2/2012 | Duni et al. | |
| 2012/0029925 | A1 | 2/2012 | Duni et al. | |
| 2012/0029926 | A1 | 2/2012 | Krishnan et al. | |
| 2012/0173231 | A1 * | 7/2012 | Li et al. | 704/225 |
| 2012/0185256 | A1 | 7/2012 | Virette et al. | |
| 2013/0013321 | A1 * | 1/2013 | Oh et al. | 704/500 |
| 2013/0117015 | A1 | 5/2013 | Bayer et al. | |
| 2013/0144615 | A1 | 6/2013 | Rauhala et al. | |
| 2013/0218577 | A1 * | 8/2013 | Taleb et al. | 704/500 |

FOREIGN PATENT DOCUMENTS

| | | | |
|---|---|---|---|
| CN | 1367618 | A | 9/2002 |
| CN | 101030378 | A | 9/2007 |
| CN | 101523485 | A | 9/2009 |
| CN | 101622661 | A | 1/2010 |
| JP | 63033935 | | 2/1988 |
| JP | S6358500 | A | 3/1988 |
| JP | H01205200 | A | 8/1989 |
| JP | H07273660 | A | 10/1995 |
| JP | H09244694 | A | 9/1997 |
| JP | H09288498 | A | 11/1997 |
| JP | H1097298 | A | 4/1998 |
| JP | H11502318 | A | 2/1999 |
| JP | 11-224099 | | 8/1999 |
| JP | 2001044844 | A | 2/2001 |
| JP | 2001249698 | A | 9/2001 |
| JP | 2002542522 | A | 12/2002 |
| JP | 2004163696 | A | 6/2004 |
| JP | 2004246038 | A | 9/2004 |
| JP | 2004538525 | A | 12/2004 |
| JP | 2005527851 | A | 9/2005 |
| JP | 2006301464 | A | 11/2006 |
| JP | 2007525707 | A | 9/2007 |
| JP | 2010518422 | A | 5/2010 |
| JP | 2011527455 | A | 10/2011 |
| WO | WO-0063886 | A1 | 10/2000 |
| WO | WO03015077 | A1 | 2/2003 |
| WO | WO-03088212 | A1 | 10/2003 |
| WO | WO 03107329 | A1 * | 12/2003 |
| WO | WO-2005078706 | A1 | 8/2005 |
| WO | WO 2009029036 | A1 * | 3/2009 |
| WO | WO2010003565 | A1 | 1/2010 |
| WO | WO2010081892 | A2 | 7/2010 |

OTHER PUBLICATIONS

3GPP2 C.S00014-D, v2.0, "Enhanced Variable Rate Codec, Speech Service Options 3, 68, 70, and 73 for Wideband Spread Spectrum Digital Systems", 3GPP2 (3rd Generation Partnership Project 2), Telecommunications Industry Association, Arlington, VA., pp. 1-308 (Jan. 25, 2010).

Murashima, A., et al., "A post-processing technique to improve coding quality of CELP under background noise" Proc. IEEE Workshop on Speech Coding, pp. 102-104 (Sep. 2000).

Oger, M., et al., "Transform audio coding with arithmetic-coded scalar quantization and model-based bit allocation" ICASSP, pp. IV-545-IV-548 (2007).

Cardinal, J., "A fact full search equivalent for mean-shape-gain vector quantizers," 20th Symp. on Inf. Theory in the Benelux, 1999, 8 pp.

Etemoglu, et al., "Structured Vector Quantization Using Linear

(56) References Cited

OTHER PUBLICATIONS

Transforms," IEEE Transactions on Signal Processing, vol. 51, No. 6, Jun. 2003, pp. 1625-1631.
ITU-T G.729.1 (May 2006), Series G: Transmission Systems and Media, Digital Systems and Networks, Digital terminal equipments—Coding of analogue signals by methods other than PCM, G.729-based embedded variable bit-rate coder: An 8-32 kbits/ scalable wideband coder bitstream interoperable with G.729, 100pp.
Matschkal, B. et al. "Joint Signal Processing for Spherical Logarithmic Quantization and DPCM," 6th Int'l ITG-Conf. on Source and Channel Coding, Apr. 2006, 6 pp.
Mehrotra S. et al., "Low Bitrate Audio Coding Using Generalized Adaptive Gain Shape Vector Quantization Across Channels", Proceeding ICASSP '09 Proceedings of the 2009 IEEE International Conference on Acoustics, Speech and Signal Processing, Apr. 2009, pp. 1-4, IEEE Computer Society.
Mittal U., et al. "Low Complexity Factorial Pulse Coding of MDCT Coefficients using Approximation of Combinatorial Functions", IEEE International Conference on Acoustics, Speech and Signal Processing, vol. 1, Apr. 15-20, 2007, pp. II-289 to II-292.
Oehler, K.L. et al., "Mean-gain-shape vector quantization," ICASSP 1993, pp. V-241-V-244.
Oshikiri, M. et al., "Efficient Spectrum Coding for Super-Wideband Speech and Its Application to Jul. 10, 2015 KHZ Bandwidth Scalable Coders", Acoustics, Speech, and Signal Processing, 2004. Proceedings. (ICASSP '04). IEEE International Conference on, May 2004, p. I-481-4, vol. 1.
Rongshan, Yu, et al., "High Quality Audio Coding Using a Novel Hybrid WLP-Subband Coding Algorithm," Fifth International Symposium on Signal Processing and its Applications, ISSPA '99, Brisbane, AU, Aug. 22-25, 1999, pp. 483-486.
Sampson, D., et al., "Fast lattice-based gain-shape vector quantisation for image-sequence coding," IEE Proc.-I, vol. 140, No. 1, Feb. 1993, pp. 56-66.
Terriberry, T.B. Pulse Vector Coding, 3 pp. Available online Jul. 22, 2011 at http://people.xiph.org/~tterribe/notes/cwrs.html.
Valin, J-M. et al., "A full-bandwidth audio codec with low complexity and very low delay," 5 pp. Available online Jul. 22, 2011 at http://jmvalin.ca/papers/celt_eusipco2009.pdf.
Valin, J-M. et al., "A High-Quality Speech and Audio Codec With Less Than 10 ms Delay," 10 pp., Available online Jul. 22, 2011 at http://jmvalin.ca/papers/celt_tasl.pdf, (published in IEEE Transactions on Audio, Speech, and Language Processing, vol. 18, No. 1, 2010, pp. 58-67).
Adoul J-P, et al., "Baseband speech coding at 2400 BPS using spherical vector quantization", International Conference on Acoustics, Speech & Signal Processing. ICASSP. San Diego, Mar. 19-21, 1984; [International Conference on Acoustics, Speech & Signal Processing. ICASSP], New York, IEEE, US, vol. 1, Mar. 19, 1984, pp. 1.12/1-1.12/4, XP002301076.
Bartkowiak Maciej, et al., "Harmonic Sinusoidal + Noise Modeling of Audio Based on Multiple FO Estimation", AES Convention 125; Oct. 2008, AES, 60 East 42nd Street, Room 2520 New York 10165-2520, USA, Oct. 1, 2008, XP040508748.
Bartkwiak et al.,"A unifying Approach to Transfor, and Sinusoidal Coding of Audio", AES Convention 124; May 2008, AES, 60 East 42nd Street, Room 2520 New York 10165-2520, USA, May 1, 2008, XP040508700, Section 2.2-4, Figure 3.
Chunghsin Yeh, et al., "Multiple Fundamental Frequency Estimation of Polyphonic Music Signals", 2005 IEEE International Conference on Acoustics, Speech, and Signal Processing—Mar. 18-23, 2005—Philadelphia, PA, USA, IEEE, Piscataway, NJ, vol. 3, Mar. 18, 2005, pp. 225-228, XP010792370, DOI: 10.1109/ICASSP.2005.1415687 ISBN: 978-0-7803-8874-1.
Doval B, et al., "Estimation o f fundamental frequency of musical sound signals", Speech Processing 1. Toronto, May 14-17, 1991; [International Conference on Acoustics, Speech & Signal Processing. ICASSP], New York, IEEE, US, vol. CONF. 16, Apr. 14, 1991, pp. 3657-3660, XP010043661, DOI: 10.1109/ICASSP.1991.151067 ISBN: 978-0-7803-0003-3.
International Search Report and Written Opinion—PCT/US2011/048056—ISA/EPO—Feb. 28, 2012.
Lee D H et al: "Cell-conditioned multistage vector quantization", Speech Processing 1. Toronto, May 14-17, 1991; [International Conference on Acoustics, Speech & Signal Processing.ICASSP], New York, IEEE,US, vol. CONF.16, Apr. 14, 1991, pp. 653-656, XP010043060, DOI: 10.1109/ICASSP.1991.150424 ISBN: 978-0-7803-0003-3.
Paiva Rui Pedro, et al., "A Methodology for Detection of Melody in Polyphonic Musical Signals", AES Convention 116; May 2004, AES, 60 East 42nd Street, Room 2520 New York 10165-2520, USA, May 1, 2004, XP040506771.
Allott D., et al., "Shape adaptive activity controlled multistage gain shape vector quantisation of images." Electronics Letters, vol. 21, No. 9 (1985): 393-395.
Pisczalski M., et al .,"Predicting Musical Pitch from Component Frequency Ratios", Acoustical Society of America, vol. 66, Issue 3, 1979, pp. 710-720.
Klapuri A., at el., "Multiple Fundamental Frequency Estimation by Summing Harmonic Amplitudes," in ISMIR, 2006, pp. 216-221.

* cited by examiner

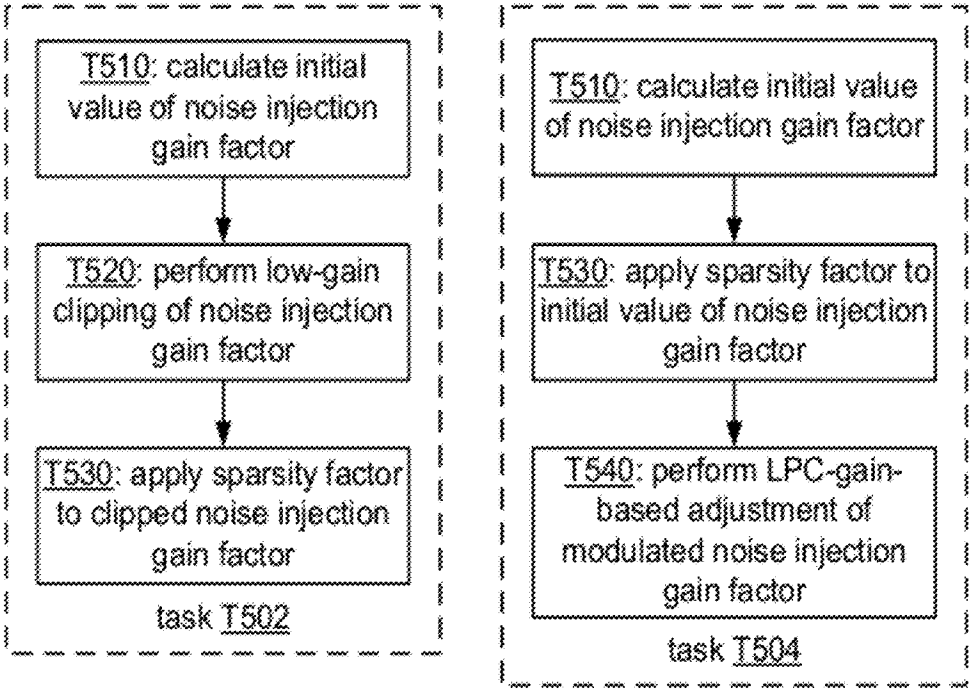
FIG. 7A
FIG. 7B
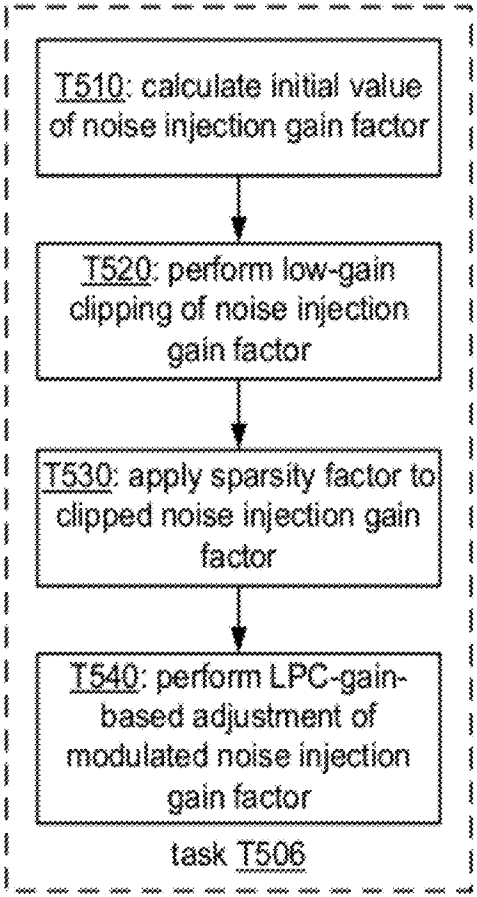
FIG. 7C

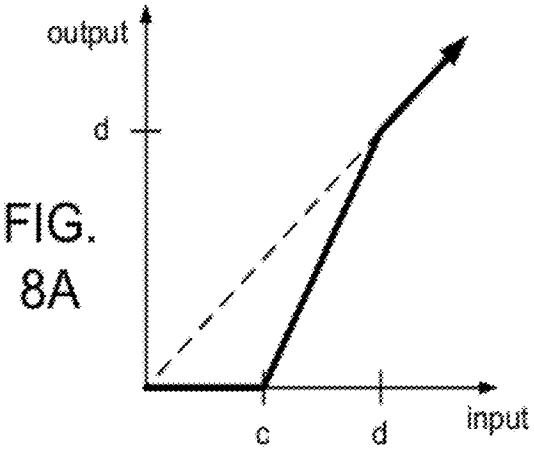
FIG. 8A
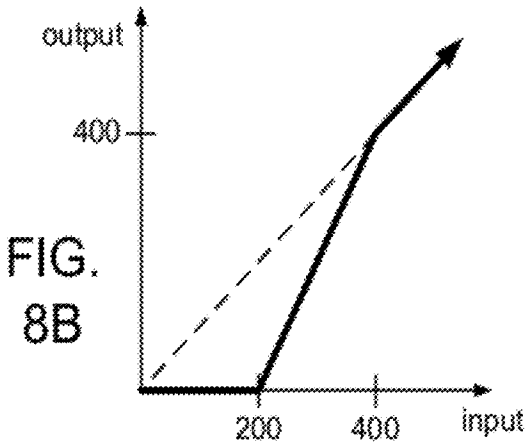
FIG. 8B
```
if (gain < 200) gain = 0;
elseif (200 <= gain < 400)
  gain = 2 * (gain - 200);
else gain = gain;
end
```
FIG. 8C
```
L = 0.5;
B = 0.7;
if (s <= L) gain = gain;
elseif ((s > L) && (s < B))
  gain *= (B - s)/(B - L);
elseif (s >= B) gain = 0;
end
```
FIG. 8D
```
z = MIN(2 - gLPC, 0);
gain *= 10^(z/20);
```
FIG. 8E

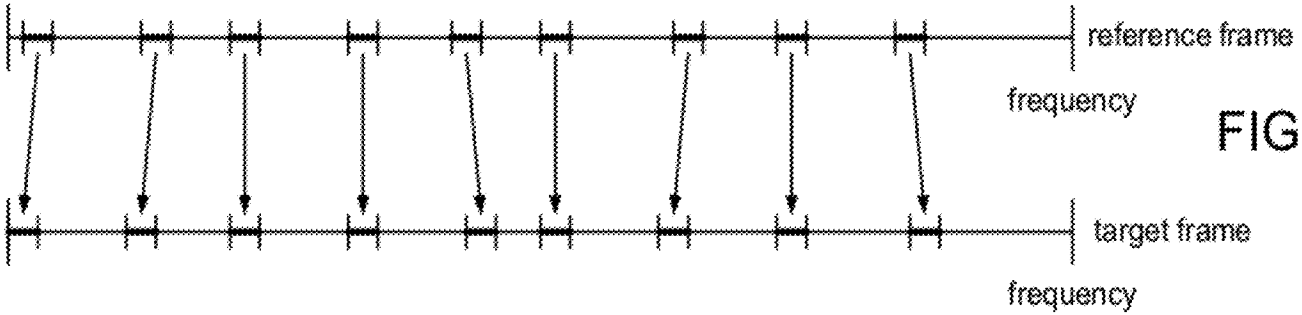
FIG. 10A
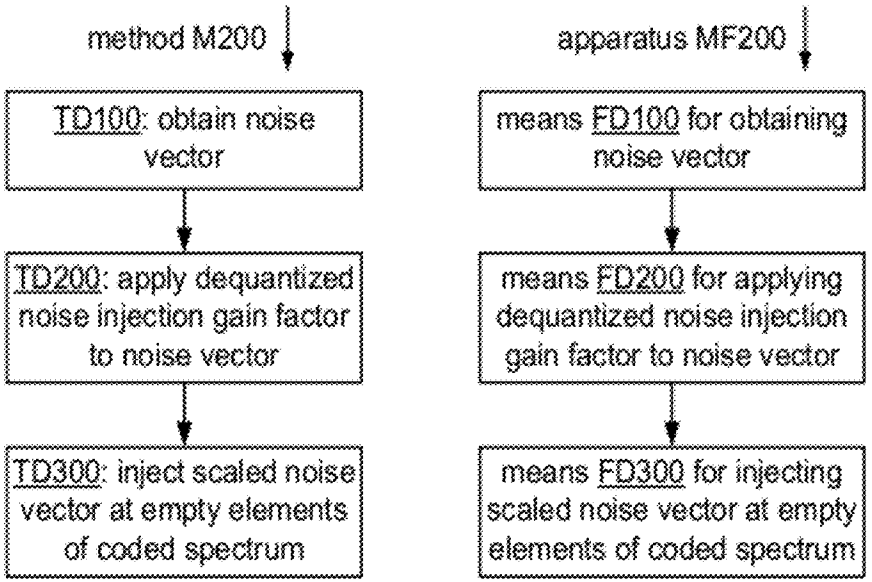
FIG. 10B
FIG. 10C
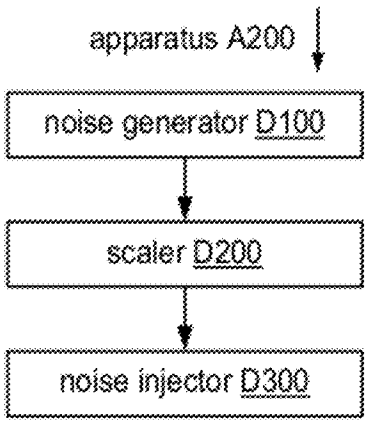
FIG. 10D

SYSTEMS, METHODS, APPARATUS, AND COMPUTER-READABLE MEDIA FOR NOISE INJECTION

CLAIM OF PRIORITY UNDER 35 U.S.C. §119

The present application for patent claims priority to Provisional Application No. 61/374,565, entitled "SYSTEMS, METHODS, APPARATUS, AND COMPUTER-READABLE MEDIA FOR GENERALIZED AUDIO CODING," filed Aug. 17, 2010. The present application for patent claims priority to Provisional Application No. 61/384,237, entitled "SYSTEMS, METHODS, APPARATUS, AND COMPUTER-READABLE MEDIA FOR GENERALIZED AUDIO CODING," filed Sep. 17, 2010. The present application for patent claims priority to Provisional Application No. 61/470,438, entitled "SYSTEMS, METHODS, APPARATUS, AND COMPUTER-READABLE MEDIA FOR DYNAMIC BIT ALLOCATION," filed Mar. 31, 2011.

BACKGROUND

1. Field

This disclosure relates to the field of audio signal processing.

2. Background

Coding schemes based on the modified discrete cosine transform (MDCT) are typically used for coding generalized audio signals, which may include speech and/or non-speech content, such as music. Examples of existing audio codecs that use MDCT coding include MPEG-1 Audio Layer 3 (MP3), Dolby Digital (Dolby Labs., London, UK; also called AC-3 and standardized as ATSC A/52), Vorbis (Xiph.Org Foundation, Somerville, Mass.), Windows Media Audio (WMA, Microsoft Corp., Redmond, Wash.), Adaptive Transform Acoustic Coding (ATRAC, Sony Corp., Tokyo, JP), and Advanced Audio Coding (AAC, as standardized most recently in ISO/IEC 14496-3:2009). MDCT coding is also a component of some telecommunications standards, such as Enhanced Variable Rate Codec (EVRC, as standardized in 3rd Generation Partnership Project 2 (3GPP2) document C.S0014-D v3.0, October 2010, Telecommunications Industry Association, Arlington, Va.). The G.718 codec ("Frame error robust narrowband and wideband embedded variable bit-rate coding of speech and audio from 8-32 kbit/s," Telecommunication Standardization Sector (ITU-T), Geneva, CH, June 2008, corrected November 2008 and August 2009, amended March 2009 and March 2010) is one example of a multi-layer codec that uses MDCT coding.

SUMMARY

A method of processing an audio signal according to a general configuration includes selecting one among a plurality of entries of a codebook, based on information from the audio signal, and determining locations, in a frequency domain, of zero-valued elements of a first signal that is based on the selected codebook entry. This method includes calculating energy of the audio signal at the determined frequency-domain locations, calculating a value of a measure of a distribution of the energy of the audio signal among the determined frequency-domain locations, and calculating a noise injection gain factor based on said calculated energy and said calculated value. Computer-readable storage media (e.g., non-transitory media) having tangible features that cause a machine reading the features to perform such a method are also disclosed.

An apparatus for processing an audio signal according to a general configuration includes means for selecting one among a plurality of entries of a codebook, based on information from the audio signal, and means for determining locations, in a frequency domain, of zero-valued elements of a first signal that is based on the selected codebook entry. This apparatus includes means for calculating energy of the audio signal at the determined frequency-domain locations, means for calculating a value of a measure of a distribution of the energy of the audio signal among the determined frequency-domain locations, and means for calculating a noise injection gain factor based on said calculated energy and said calculated value.

An apparatus for processing an audio signal according to another general configuration includes a vector quantizer configured to select one among a plurality of entries of a codebook, based on information from the audio signal, and a zero-value detector configured to determine locations, in a frequency domain, of zero-valued elements of a first signal that is based on the selected codebook entry. This apparatus includes an energy calculator configured to calculate energy of the audio signal at the determined frequency-domain locations, a sparsity calculator configured to calculate a value of a measure of a distribution of the energy of the audio signal among the determined frequency-domain locations, and a gain factor calculator configured to calculate a noise injection gain factor based on said calculated energy and said calculated value.

BRIEF DESCRIPTION OF THE DRAWINGS

FIG. 7A shows a flowchart of such an implementation T502 of task T500.

FIG. 7B shows a flowchart of an implementation T504 of task T500.

FIG. 7C shows a flowchart of an implementation T506 of tasks T502 and T504.

FIG. 8A shows a plot of a clipping operation for an example of task T520.

FIG. 8B shows a plot of an example of task T520 for particular threshold values.

FIG. 8C shows a pseudocode listing that may be executed to perform an implementation of task T520.

FIG. 8D shows a pseudocode listing that may be executed to perform a sparsity-based modulation of a noise injection gain factor.

FIG. 8E shows a pseudocode listing that may be executed to perform an implementation of task T540.

FIG. 10A shows an example of a relation between subband locations in a reference frame and a target frame.

FIG. 10B shows a flowchart of a method M200 of noise injection according to a general configuration.

FIG. 10C shows a block diagram of an apparatus for noise injection MF200 according to a general configuration.

FIG. 10D shows a block diagram of an apparatus for noise injection A200 according to another general configuration.

DETAILED DESCRIPTION

Figure 1:
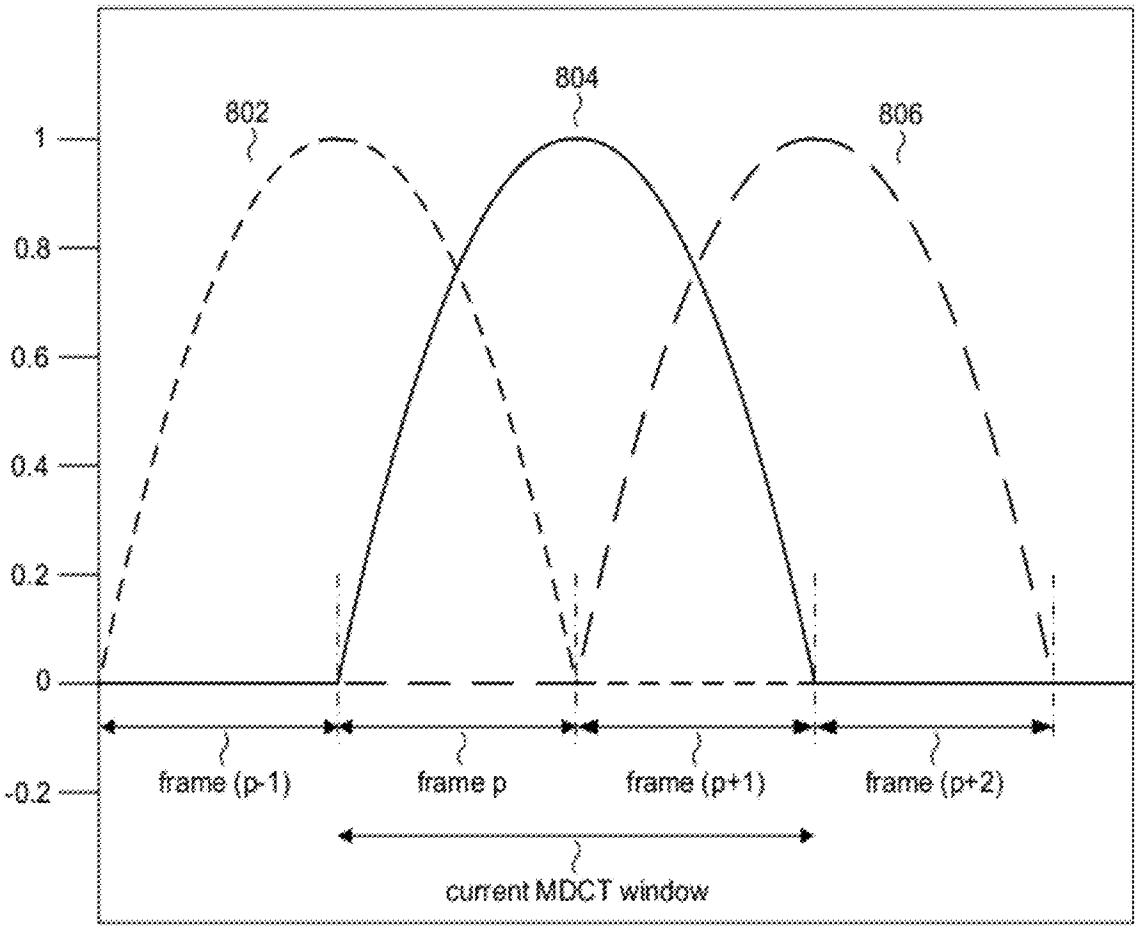
FIG. 1 shows three examples of a typical sinusoidal window shape for an MDCT operation.

In a system for encoding signal vectors for storage or transmission, it may be desirable to include a noise injection algorithm to suitably adjust the gain, spectral shape, and/or other characteristics of the injected noise in order to maximize perceptual quality while minimizing the amount of information to be transmitted. For example, it may be desirable to apply a sparsity factor as described herein to control such a noise injection scheme (e.g., to control the level of the noise to be injected). It may be desirable in this regard to take particular care to avoid adding noise to audio signals which are not noise-like, such as highly tonal signals or other sparse spectra, as it may be assumed that these signals are already well-coded by the underlying coding scheme. Likewise, it may be beneficial to shape the spectrum of the injected noise in relation to the coded signal, or otherwise to adjust its spectral characteristics.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency-domain representation of the signal (e.g., as produced by a fast Fourier transform or MDCT) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. A "task" having multiple subtasks is also a method. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The systems, methods, and apparatus described herein are generally applicable to coding representations of audio signals in a frequency domain. A typical example of such a representation is a series of transform coefficients in a transform domain. Examples of suitable transforms include discrete orthogonal transforms, such as sinusoidal unitary transforms. Examples of suitable sinusoidal unitary transforms include the discrete trigonometric transforms, which include without limitation discrete cosine transforms (DCTs), discrete sine transforms (DSTs), and the discrete Fourier transform (DFT). Other examples of suitable transforms include lapped versions of such transforms. A particular example of a suitable transform is the modified DCT (MDCT) introduced above.

Reference is made throughout this disclosure to a "low-band" and a "highband" (equivalently, "upper band") of an audio frequency range, and to the particular example of a lowband of zero to four kilohertz (kHz) and a highband of 3.5 to seven kHz. It is expressly noted that the principles discussed herein are not limited to this particular example in any way, unless such a limit is explicitly stated. Other examples (again without limitation) of frequency ranges to which the application of these principles of encoding, decoding, allocation, quantization, and/or other processing is expressly contemplated and hereby disclosed include a lowband having a lower bound at any of 0, 25, 50, 100, 150, and 200 Hz and an upper bound at any of 3000, 3500, 4000, and 4500 Hz, and a highband having a lower bound at any of 3000, 3500, 4000, 4500, and 5000 Hz and an upper bound at any of 6000, 6500, 7000, 7500, 8000, 8500, and 9000 Hz. The application of such principles (again without limitation) to a highband having a lower bound at any of 3000, 3500, 4000, 4500, 5000, 5500, 6000, 6500, 7000, 7500, 8000, 8500, and 9000 Hz and an upper bound at any of 10, 10.5, 11, 11.5, 12, 12.5, 13, 13.5, 14, 14.5, 15, 15.5, and 16 kHz is also expressly contemplated and hereby disclosed. It is also expressly noted that although a highband signal will typically be converted to a lower sampling rate at an earlier stage of the coding process (e.g., via resampling and/or decimation), it remains a highband signal and the information it carries continues to represent the highband audio-frequency range.

A coding scheme that includes calculation and/or application of a noise injection gain as described herein may be applied to code any audio signal (e.g., including speech). Alternatively, it may be desirable to use such a coding scheme only for non-speech audio (e.g., music). In such case, the coding scheme may be used with a classification scheme to determine the type of content of each frame of the audio signal and select a suitable coding scheme.

A coding scheme that includes calculation and/or application of a noise injection gain as described herein may be used as a primary codec or as a layer or stage in a multi-layer or multi-stage codec. In one such example, such a coding scheme is used to code a portion of the frequency content of an audio signal (e.g., a lowband or a highband), and another coding scheme is used to code another portion of the frequency content of the signal. In another such example, such a coding scheme is used to code a residual (i.e., an error between the original and encoded signals) of another coding layer.

It may be desirable to process an audio signal as a representation of the signal in a frequency domain. A typical example of such a representation is a series of transform coefficients in a transform domain. Such a transform-domain representation of the signal may be obtained by performing a transform operation (e.g., an FFT or MDCT operation) on a frame of PCM (pulse-code modulation) samples of the signal in the time domain. Transform-domain coding may help to increase coding efficiency, for example, by supporting coding schemes that take advantage of correlation in the energy spectrum among subbands of the signal over frequency (e.g., from one subband to another) and/or time (e.g., from one frame to another). The audio signal being processed may be a residual of another coding operation on an input signal (e.g., a speech and/or music signal). In one such example, the audio signal being processed is a residual of a linear prediction coding (LPC) analysis operation on an input audio signal (e.g., a speech and/or music signal).

Methods, systems, and apparatus as described herein may be configured to process the audio signal as a series of segments. A segment (or "frame") may be a block of transform coefficients that corresponds to a time-domain segment with a length typically in the range of from about five or ten milliseconds to about forty or fifty milliseconds. The time-domain segments may be overlapping (e.g., with adjacent segments overlapping by 25% or 50%) or nonoverlapping.

It may be desirable to obtain both high quality and low delay in an audio coder. An audio coder may use a large frame size to obtain high quality, but unfortunately a large frame size typically causes a longer delay. Potential advantages of an audio encoder as described herein include high quality coding with short frame sizes (e.g., a twenty-millisecond frame size, with a ten-millisecond lookahead). In one particular example, the time-domain signal is divided into a series of twenty-millisecond nonoverlapping segments, and the MDCT for each frame is taken over a forty-millisecond window that overlaps each of the adjacent frames by ten milliseconds. One example of an MDCT transform operation that may be used to produce an audio signal to be processed by a system, method, or apparatus as disclosed herein is described in section 4.13.4 (Modified Discrete Cosine Transform (MDCT), pp. 4-134 to 4-135) of the document C.S0014-D v3.0 cited above, which section is hereby incorporated by reference as an example of an MDCT transform operation.

A segment as processed by a method, system, or apparatus as described herein may also be a portion (e.g., a lowband or highband) of a block as produced by the transform, or a portion of a block as produced by a previous operation on such a block. In one particular example, each of a series of segments (or "frames") processed by such a method, system, or apparatus contains a set of 160 MDCT coefficients that represent a lowband frequency range of 0 to 4 kHz. In another particular example, each of a series of frames processed by such a method, system, or apparatus contains a set of 140 MDCT coefficients that represent a highband frequency range of 3.5 to 7 kHz.

An MDCT coding scheme uses an encoding window that extends over (i.e., overlaps) two or more consecutive frames. For a frame length of M, the MDCT produces M coefficients based on an input of 2M samples. One feature of an MDCT coding scheme, therefore, is that it allows the transform window to extend over one or more frame boundaries without increasing the number of transform coefficients needed to represent the encoded frame.

Calculation of the M MDCT coefficients may be expressed as $X(k)=\Sigma_{n=0}^{2M-1}x(n)h_k(n)$, where $$h_k(n) = w(n)\sqrt{\frac{2}{M}}\cos\left[\frac{(2n+M+1)(2k+1)\pi}{4M}\right]$$

for k=0, 1, . . . , M−1. The function w(n) is typically selected to be a window that satisfies the condition $w^2(n)+w^2(n+M)=1$ (also called the Princen-Bradley condition). The corresponding inverse MDCT operation may be expressed as $\hat{x}(n)=\Sigma_{k=0}^{M-1}\hat{X}(k)h_k(n)$ for n=0, 1, . . . , 2M−1, where $\hat{X}(k)$ are the M received MDCT coefficients and $\hat{x}(n)$ are the 2M decoded samples.

FIG. 1 shows three examples of a typical sinusoidal window shape for an MDCT operation. This window shape, which satisfies the Princen-Bradley condition, may be expressed as $$w(n) = \sin\left(\frac{n\pi}{2M}\right)$$

for $0 \le n < 2M$, where n=0 indicates the first sample of the current frame. As shown in the figure, the MDCT window 804 used to encode the current frame (frame p) has non-zero values over frame p and frame (p+1), and is otherwise zero-valued. The MDCT window 802 used to encode the previous frame (frame (p−1)) has non-zero values over frame (p−1) and frame p, and is otherwise zero-valued, and the MDCT window 806 used to encode the following frame (frame (p+1)) is analogously arranged. At the decoder, the decoded sequences are overlapped in the same manner as the input sequences and added. Even though the MDCT uses an overlapping window function, it is a critically sampled filter bank because after the overlap-and-add, the number of input samples per frame is the same as the number of MDCT coefficients per frame.

Figure 2:
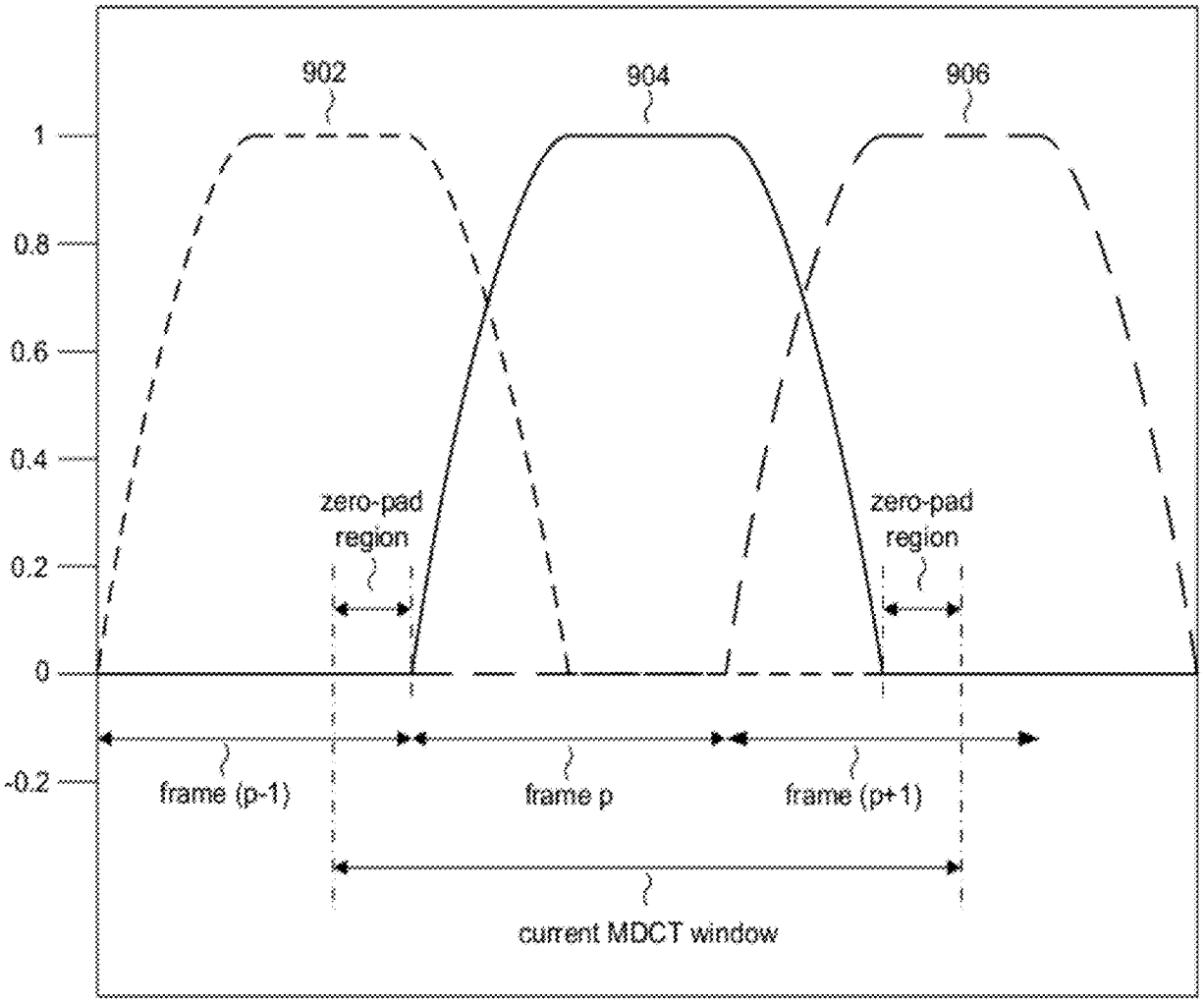
FIG. 2 shows one example of a different window function w(n).

FIG. 2 shows one example of a window function w(n) that may be used (e.g., in place of the function w(n) as illustrated in FIG. 1) to allow a lookahead interval that is shorter than M. In the particular example shown in FIG. 2, the lookahead interval is M/2 samples long, but such a technique may be implemented to allow an arbitrary lookahead of L samples, where L has any value from 0 to M. In this technique (examples of which are described in section 4.13.4 of document C.S0014-D incorporated by reference above), the MDCT window begins and ends with zero-pad regions of length (M-L)/2, and w(n) satisfies the Princen-Bradley condition. One implementation of such a window function may be expressed as follows:

$$w(n) = \begin{cases} 0, & 0 \le n < \frac{M-L}{2} \\ \sin\left[\frac{\pi}{2L}\left(n - \frac{M-L}{2}\right)\right], & \frac{M-L}{2} \le n < \frac{M+L}{2} \\ 1, & \frac{M+L}{2} \le n < \frac{3M-L}{2} \\ \sin\left[\frac{\pi}{2L}\left(3L + n - \frac{3M-L}{2}\right)\right], & \frac{3M-L}{2} \le n < \frac{3M+L}{2} \\ 0, & \frac{3M+L}{2} \le n < 2M, \end{cases}$$

where $$n = \frac{M-L}{2}$$

is the first sample of the current frame p and $$n = \frac{3M-L}{2}$$

is the first sample of the next frame (p+1). A signal encoded according to such a technique retains the perfect reconstruction property (in the absence of quantization and numerical errors). It is noted that for the case L=M, this window function is the same as the one illustrated in FIG. 1, and for the case L=0, w(n)=1 for $$\frac{M}{2} \le n < \frac{3M}{2}$$

and is zero elsewhere such that there is no overlap.

When coding audio signals in a frequency domain (e.g., an MDCT or FFT domain), especially at a low bit rate and high sampling rate, significant portions of the coded spectrum may contain zero energy. This result may be particularly true for signals that are residuals of one or more other coding operations, which tend to have low energy to begin with. This result may also be particularly true in the higher-frequency portions of the spectrum, owing to the "pink noise" average shape of audio signals. Although these regions are typically less important overall than the regions which are coded, their complete absence in the decoded signal can nevertheless result in annoying artifacts, a general "dullness," and/or a lack of naturalness.

For many practical classes of audio signals, the content of such regions may be well-modeled psychoacoustically as noise. Thus, it may be desirable to reduce such artifacts by injecting noise into the signal during decoding. For a minimal cost in bits, such noise injection can be applied as a post-processing operation to a spectral-domain audio coding scheme. At the encoder, such an operation may include calculating a suitable noise injection gain factor to be encoded as a parameter of the coded signal. At the decoder, such an operation may include filling the empty regions of the input coded signal with noise modulated according to the noise injection gain factor.

Figure 3B:
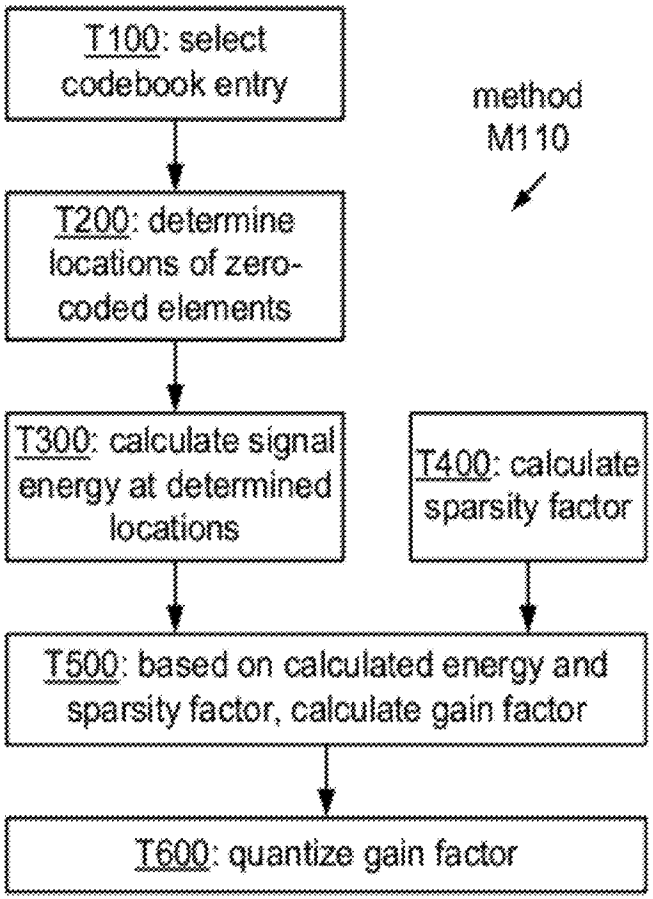
FIG. 3B shows a flowchart of an implementation M110 of method M100.
Figure 3A:
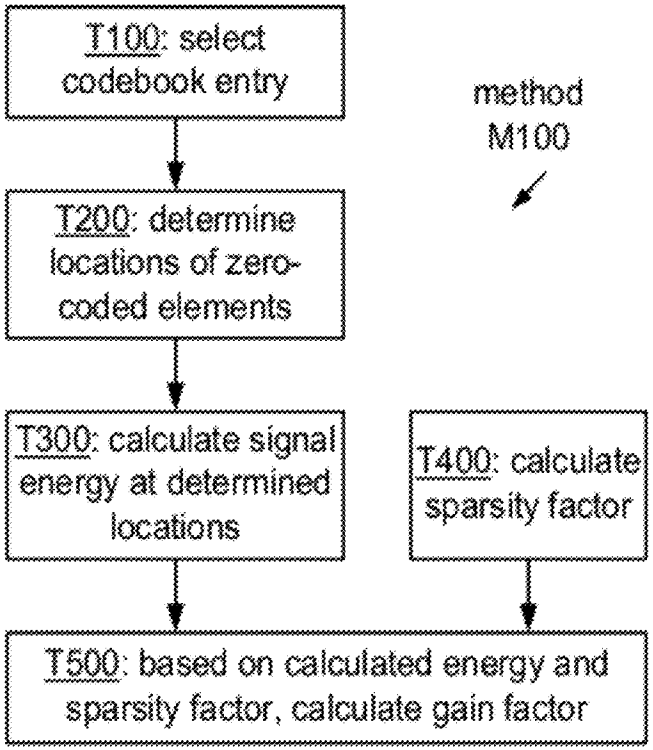
FIG. 3A shows a block diagram of a method M100 of processing an audio signal according to a general configuration.

FIG. 3A shows a block diagram of a method M100 of processing an audio signal according to a general configuration that includes tasks T100, T200, T300, T400, and T500. Based on information from the audio signal, task T100 selects one among a plurality of entries of a codebook. In a split VQ or multi-stage VQ scheme, task T100 may be configured to quantize a signal vector by selecting an entry from each of two or more codebooks. Task T200 determines locations, in a frequency domain, of zero-valued elements of the selected codebook entry (or location of such elements of a signal based on the selected codebook entry, such as a signal based on one or more additional codebook entries). Task T300 calculates energy of the audio signal at the determined frequency-domain locations. Task T400 calculates a value of a measure of distribution of energy within the audio signal. Based on the calculated energy and the calculated energy distribution value, task T500 calculates a noise injection gain factor. Method M100 is typically implemented such that a respective instance of the method executes for each frame of the audio signal (e.g., for each block of transform coefficients). Method M100 may be configured to take as its input an audio spectrum (spanning an entire bandwidth, or some subband). In one example, the audio signal processed by method M100 is a UB-MDCT spectrum in the LPC residual domain.

It may be desirable to configure task T100 to produce a coded version of the audio signal by processing a set of transform coefficients for a frame of the audio signal as a vector. For example, task T100 may be implemented to perform a vector quantization (VQ) scheme, which encodes a vector by matching it to an entry in a codebook (which is also known to the decoder). In a conventional VQ scheme, the codebook is a table of vectors, and the index of the selected entry within this table is used to represent the vector. The length of the codebook index, which determines the maximum number of entries in the codebook, may be any arbitrary integer that is deemed suitable for the application. In a pulse-coding VQ scheme, the selected codebook entry (which may also be referred to as a codebook index) describes a particular pattern of pulses. In the case of pulse coding, the length of the entry (or index) determines the maximum number of pulses in the corresponding pattern. In a split VQ or multi-stage VQ scheme, task T100 may be configured to quantize a signal vector by selecting an entry from each of two or more codebooks.

Gain-shape vector quantization is a coding technique that may be used to efficiently encode signal vectors (e.g., representing audio or image data) by decoupling the vector energy, which is represented by a gain factor, from the vector direction, which is represented by a shape. Such a technique may be especially suitable for applications in which the dynamic range of the signal may be large, such as coding of audio signals (e.g., signals based on speech and/or music).

Figure 4A:
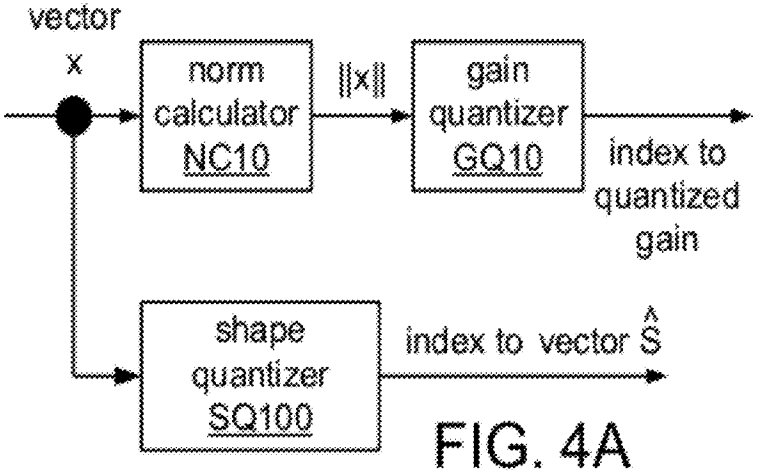
FIGS. 4A-C show examples of gain-shape vector quantization structures.

A gain-shape vector quantizer (GSVQ) encodes the shape and gain of a signal vector x separately. FIG. 4A shows an example of a gain-shape vector quantization operation. In this example, shape quantizer SQ100 is configured to perform a VQ scheme by selecting the quantized shape vector $\hat{S}$ from a codebook as the closest vector in the codebook to signal vector x (e.g., closest in a mean-square-error sense) and outputting the index to vector $\hat{S}$ in the codebook. Norm calculator NC10 is configured to calculate the norm $\|x\|$ of signal vector x, and gain quantizer GQ10 is configured to quantize the norm to produce a quantized gain factor. Gain quantizer GQ10 may be configured to quantize the norm as a scalar or to combine the norm with other gains (e.g., norms from others of the plurality of vectors) into a gain vector for vector quantization.

Shape quantizer SQ100 is typically implemented as a vector quantizer with the constraint that the codebook vectors have unit norm (i.e., are all points on the unit hypersphere). This constraint simplifies the codebook search (e.g., from a mean-squared error calculation to an inner product operation). For example, shape quantizer SQ100 may be configured to select vector $\hat{S}$ from among a codebook of K unit-norm vectors $S_k$, k=0, 1, . . . , K−1, according to an operation such as $\arg\max_k(x^T S_k)$. Such a search may be exhaustive or optimized. For example, the vectors may be arranged within the codebook to support a particular search strategy.

Figure 4B:
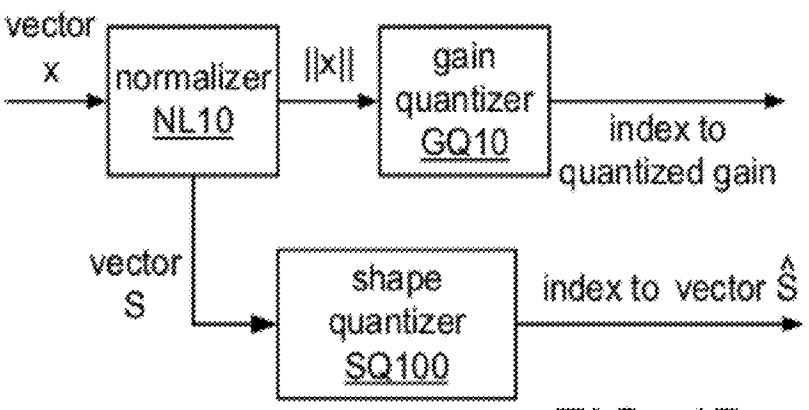

In some cases, it may be desirable to constrain the input to shape quantizer SQ100 to be unit-norm (e.g., to enable a particular codebook search strategy). FIG. 4B shows such an example of a gain-shape vector quantization operation. In this example, normalizer NL10 is configured to normalize signal vector x to produce vector norm $\|x\|$ and a unit-norm shape vector $S=x/\|x\|$, and shape quantizer SQ100 is arranged to receive shape vector S as its input. In such case, shape quantizer SQ100 may be configured to select vector $\hat{S}$ from among a codebook of K unit-norm vectors $S_k$, k=0, 1, . . . , K−1, according to an operation such as $\arg\max_k(S^T S_k)$.

Figure 4C:
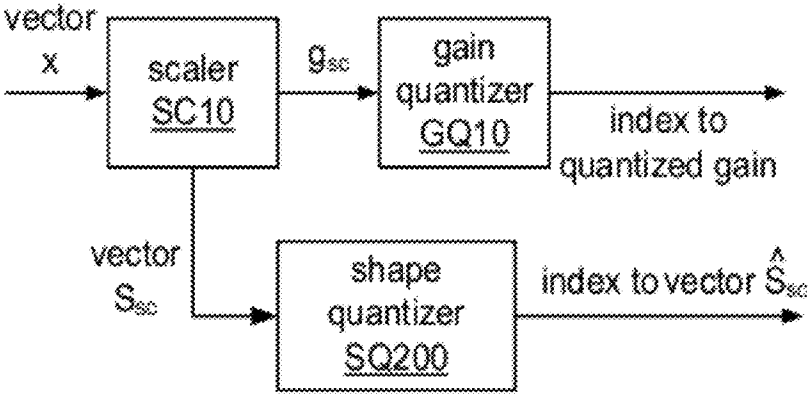

Alternatively, a shape quantizer may be configured to select the coded vector from among a codebook of patterns of unit pulses. FIG. 4C shows an example of such a gain-shape vector quantization operation. In this case, quantizer SQ200 is configured to select the pattern that is closest to a scaled shape vector $S_{sc}$ (e.g., closest in a mean-square-error sense). Such a pattern is typically encoded as a codebook entry that indicates the number of pulses and the sign for each occupied position in the pattern. Selecting the pattern may include scaling the signal vector (e.g., in scaler SC10) to obtain shape vector $S_{sc}$ and a corresponding scalar scale factor $g_{sc}$, and then matching the scaled shape vector $S_{sc}$ to the pattern. In this case, scaler SC10 may be configured to scale signal vector x to produce scaled shape vector $S_{sc}$ such that the sum of the absolute values of the elements of $S_{sc}$ (after rounding each element to the nearest integer) approximates a desired value (e.g., 23 or 28). The corresponding dequantized signal vector may be generated by using the resulting scale factor $g_{sc}$ to normalize the selected pattern. Examples of pulse coding schemes that may be performed by shape quantizer SQ200 to encode such patterns include factorial pulse coding and combinatorial pulse coding. One example of a pulse-coding vector quantization operation that may be performed within a system, method, or apparatus as disclosed herein is described in sections 4.13.5 (MDCT Residual Line Spectrum Quantization, pp. 4-135 to 4-137) and 4.13.6 (Global Scale Factor Quantization, p. 4-137) of the document C.S0014-D v3.0 cited above, which sections are hereby incorporated by reference as an example of an implementation of task T100.

Figure 5:
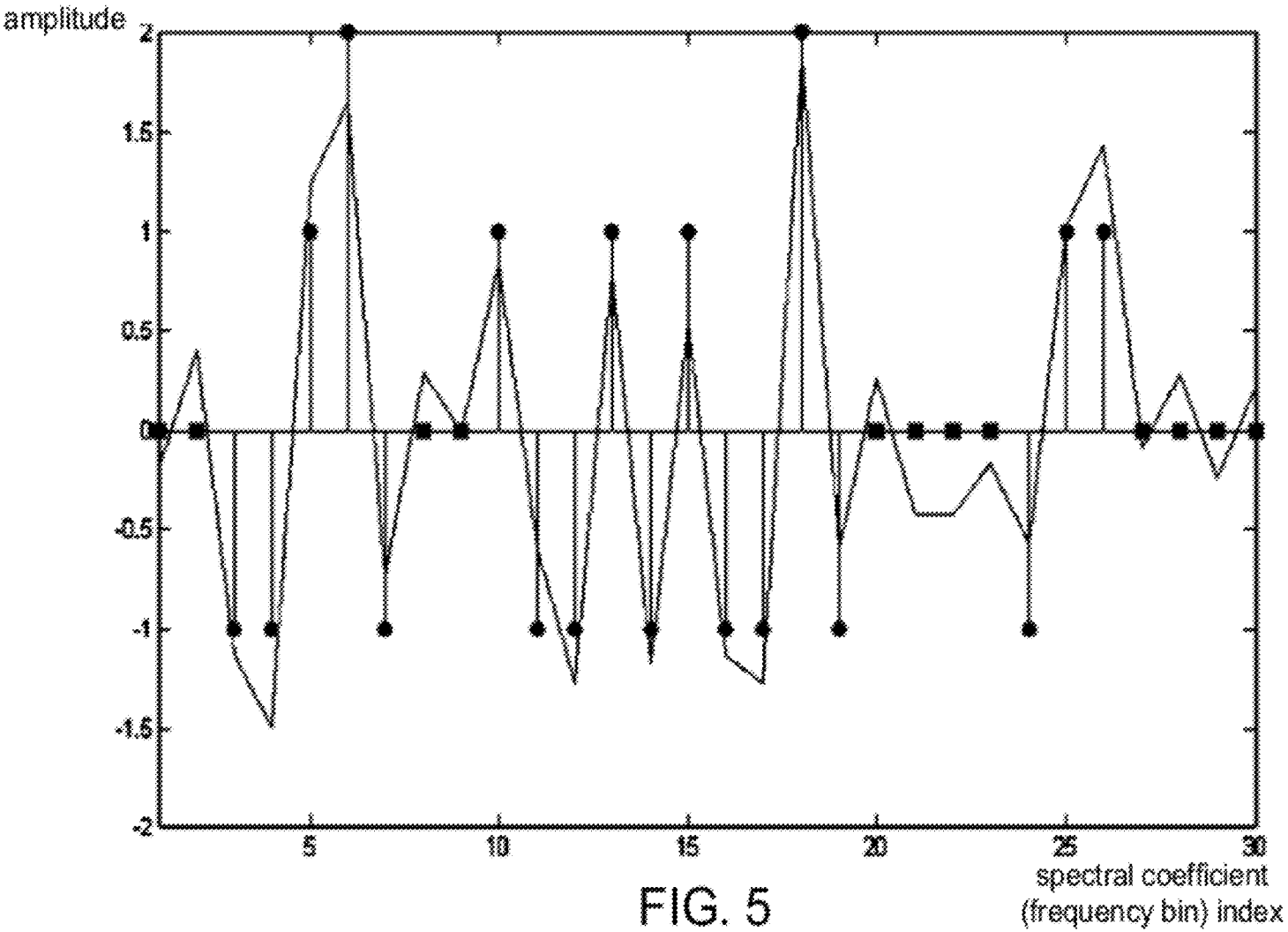
FIG. 5 shows an example of an input spectrum vector before and after pulse encoding.

FIG. 5 shows an example of an input spectrum vector (e.g., an MDCT spectrum) before and after pulse encoding. In this example, the thirty-dimensional vector, whose original value at each dimension is indicated by the solid line, is represented by the pattern of pulses (0, 0, −1, −1, +1, +2, −1, 0, 0, +1, −1, −1, +1, −1, +1, −1, −1, +2, −1, 0, 0, 0, 0, −1, +1, +1, 0, 0, 0, 0), as shown by the dots which indicate the coded spectrum and the squares which indicate the zero-valued elements. This pattern of pulses can typically be represented by a codebook entry (or index) that is much less than thirty bits.

Task T200 determines locations of zero-valued elements in the coded spectrum. In one example, task T200 is implemented to produce a zero detection mask according to an expression such as the following:

$$z_d(k) = \begin{cases} 1, & X_c(k) = 0 \\ 0, & \text{otherwise,} \end{cases} \tag{1}$$

where $z_d$ denotes the zero detection mask, $X_c$ denotes the coded input spectrum vector, and k denotes a sample index. For the coded example shown in FIG. 5, such a mask has the form {1,1,0,0,0,0,0,1,1,0,0,0,0,0,0,0,0,0,0,1,1,1,1,0,0,0,1,1,1,1}. In this case, forty percent of the original vector (twelve of the thirty elements) is coded as zero-valued elements.

It may be desirable to configure task T200 to indicate locations of zero-valued elements within a subband of the frequency range of the signal. In one such example, $X_c$ is a vector of 160 MDCT coefficients that represent a lowband frequency range of 0 to 4 kHz, and task T200 is implemented to produce a zero detection mask according to an expression such as the following:

$$z_d(k) = \begin{cases} 1, & 40 \le k \le 143 \text{ and } X_c(k) = 0 \\ 0, & \text{otherwise} \end{cases} \tag{2}$$

(e.g., for detection of zero-valued elements over the frequency range of 1000 to 3600 Hz).

Task T300 calculates an energy of the audio signal at the frequency-domain locations determined in task T200 (e.g., as indicated by the zero detection mask). The input spectrum at these locations may also be referred to as the "uncoded input spectrum" or "uncoded regions of the input spectrum." In a typical example, task T300 is configured to calculate the energy as a sum of the squares of the values of the audio signal at these locations. For the case illustrated in FIG. 5, task T300 may be configured to calculate the energy as a sum of the squares of the values of the input spectrum at the frequency-domain locations that are marked by squares. Such a calculation may be performed according to an expression such as the following: $\Sigma_{k=0}^{K-1} z_d(k) X_k^2$, where K denotes the length of input vector X. In a further example, this summation is limited to a subband over which the zero detection mask is calculated in task T200 (e.g., over the range 40≤k≤143). It will be understood that in the case of a transform that produces complex-valued coefficients, the energy may be calculated as a sum of the squares of the magnitudes of the values of the audio signal at the locations determined by task T200.

Based on a measure of a distribution of the energy within the uncoded spectrum (i.e., among the determined frequency-domain locations of the audio signal), task T400 calculates a corresponding sparsity factor. Task T400 may be configured to calculate the sparsity factor based on a relation between a total energy of the uncoded spectrum (e.g., as calculated by task T300) and a total energy of a subset of the coefficients of the uncoded spectrum. In one such example, the subset is selected from among the coefficients having the highest energy in the uncoded spectrum. It may be understood that the relation between these values [e.g., (energy of subset)/(total energy of uncoded spectrum)] indicates a degree to which energy of the uncoded spectrum is concentrated or distributed.

Figure 6B:
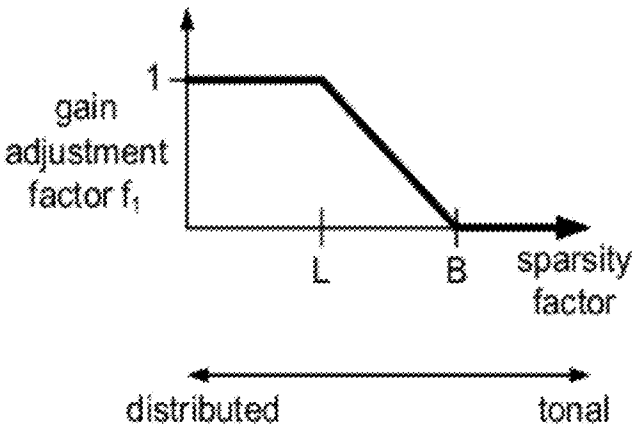
FIG. 6B shows a plot of a mapping of the value of a sparsity factor to a value of a gain adjustment factor.
Figure 6C:
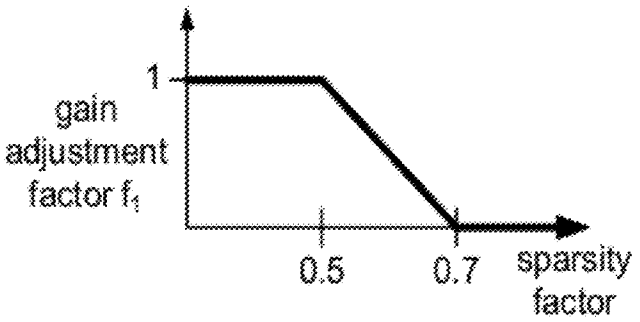
FIG. 6C shows a plot of the mapping of FIG. 6B for particular threshold values.
Figure 6A:
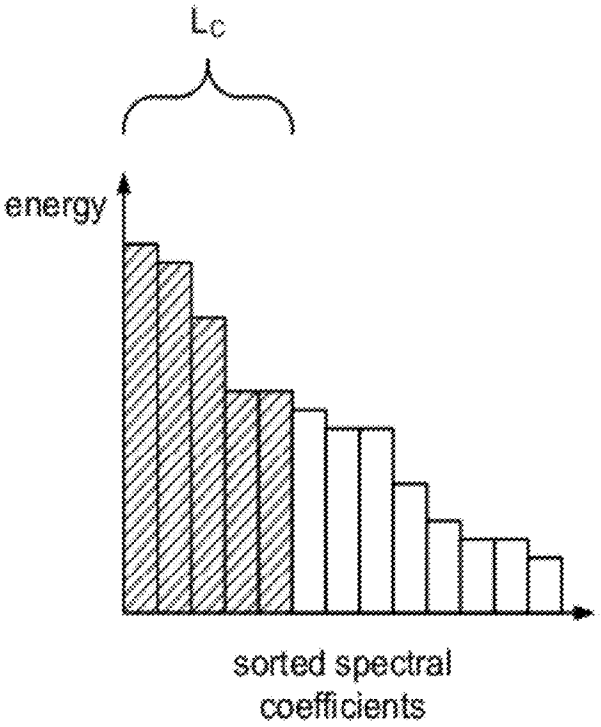
FIG. 6A shows an example of a subset in a sorted set of spectral-coefficient energies.

In one example, task T400 calculates the sparsity factor as the sum of the energies of the $L_C$ highest-energy coefficients of the uncoded input spectrum, divided by the total energy of the uncoded input spectrum (e.g., as calculated by task T300). Such a calculation may include sorting the energies of the elements of the uncoded input spectrum vector in descending order. It may be desirable for $L_C$ to have a value of about five, six, seven, eight, nine, ten, fifteen or twenty percent of the total number of coefficients in the uncoded input spectrum vector. FIG. 6A illustrates an example of selecting the $L_C$ highest-energy coefficients.

Examples of values for $L_C$ include 5, 10, 15, and 20. In one particular example, $L_C$ is equal to ten, and the length of the highband input spectrum vector is 140 (alternatively, and the length of the lowband input spectrum vector is 144). In the examples described herein, it is assumed that task T400 calculates the sparsity factor on a scale of from zero (e.g., no energy) to one (e.g., all energy is concentrated in the $L_C$ highest-energy coefficients), but one of ordinary skill will appreciate that neither these principles nor their description herein is limited to such a constraint.

In one example, task T400 is implemented to calculate the sparsity factor according to an expression such as the following:

$$\beta = \sqrt{\frac{\sum_{X_i \in L_C} X_i^2}{\sum_{k=0}^{K-1} z_d(k) X_k^2}}, \tag{3}$$

where β denotes the sparsity factor and K denotes the length of the input vector X. (In such case, the denominator of the fraction in expression (3) may be obtained from task T300.) In a further example, the pool from which the $L_C$ coefficients are selected, and the summation in the denominator of expression (3), are limited to a subband over which the zero detection mask is calculated in task T200 (e.g., over the range $40 \le k \le 143$).

In another example, task T400 is implemented to calculate the sparsity factor based on the number of the highest-energy coefficients of the uncoded spectrum whose energy sum exceeds (alternatively, is not less than) a specified portion of the total energy of the uncoded spectrum (e.g., 5, 10, 12, 15, 20, 25, or 30 percent of the total energy of the uncoded spectrum). Such a calculation may also be limited to a subband over which the zero detection mask is calculated in task T200 (e.g., over the range $40 \le k \le 143$).

Task T500 calculates a noise injection gain factor that is based on the energy of the uncoded input spectrum as calculated by task T300 and on the sparsity factor of the uncoded input spectrum as calculated by task T400. Task T500 may be configured to calculate an initial value of a noise injection gain factor that is based on the calculated energy at the determined frequency-domain locations. In one such example, task T500 is implemented to calculate the initial value of the noise injection gain factor according to an expression such as the following:

$$\gamma_{ni} = \alpha \sqrt{\frac{\sum_{k=0}^{K-1} z_d(k) X_k^2}{\sum_{k=0}^{K-1} X_k^2}}, \tag{4}$$

where $\gamma_{ni}$ denotes the noise injection gain factor, K denotes the length of the input vector X, and α is a factor having a value not greater than one (e.g., 0.8 or 0.9). (In such case, the numerator of the fraction in expression (4) may be obtained from task T300.) In a further example, the summations in expression (4) are limited to a subband over which the zero detection mask is calculated in task T200 (e.g., over the range $40 \le k \le 143$).

It may be desirable to reduce the noise gain when the sparsity factor has a high value (i.e., when the uncoded spectrum is not noise-like). Task T500 may be configured to use the sparsity factor to modulate the noise injection gain factor such that the value of the gain factor decreases as the sparsity factor increases. FIG. 6B shows a plot of a mapping of the value of sparsity factor β to a value of a gain adjustment factor $f_1$ according to a monotonically decreasing function. Such a modulation may be included in the calculation of noise injection gain factor $\gamma_{ni}$ (e.g., may be applied to the right-hand side of expression (4) above to produce the noise injection gain factor), or factor $f_1$ may be used to update an initial value of noise injection gain factor $\gamma_{ni}$ according to an expression such as $\gamma_{ni} \leftarrow f_1 \times \gamma_{ni}$.

The particular example shown in FIG. 6B passes the gain value unchanged for sparsity factor values less than a specified lower threshold value L, linearly reduces the gain value for sparsity factor values between L and a specified upper threshold value B, and clips the gain value to zero for sparsity factor values greater than B. The line below this plot illustrates that low values of the sparsity factor indicate a lower degree of energy concentration (e.g., a more distributed energy spectrum) and that higher values of the sparsity factor indicate a higher degree of energy concentration (e.g., a tonal signal). FIG. 6C shows this example for values of L=0.5 and B=0.7 (where the value of the sparsity factor is assumed to be in the range [0,1]). These examples may also be implemented such that the reduction is nonlinear. FIG. 8D shows a pseudocode listing that may be executed to perform a sparsity-based modulation of the noise injection gain factor according to the mapping shown in FIG. 6C.

It may be desirable to quantize the sparsity-modulated noise injection gain factor using a small number of bits and to transmit the quantized factor as side information of the frame. FIG. 3B shows a flowchart of an implementation M110 of method M100 that includes a task T600 which quantizes the modulated noise injection gain factor produced by task T500. For example, task T600 may be configured to quantize the noise injection gain factor on a logarithmic scale (e.g., a decibel scale) using a scalar quantizer (e.g., a three-bit scalar quantizer).

Task T500 may also be configured to modulate the noise injection gain factor according to its own magnitude. FIG. 7A shows a flowchart of such an implementation T502 of task T500 that includes subtasks T510, T520, and T530. Task T510 calculates an initial value for the noise injection gain factor (e.g., as described above with reference to expression (4)). Task T520 performs a low-gain clipping operation on the initial value. For example, task T520 may be configured to reduce values of the gain factor that are below a specified threshold value to zero. FIG. 8A shows a plot of such an operation for an example of task T520 that clips gain values below a threshold value c to zero, linearly maps values in the range of c to d to the range of zero to d, and passes higher values without change. FIG. 8B shows a particular example of task T520 for the values c=200, d=400. These examples may also be implemented such that the mapping is nonlinear. Task T530 applies the sparsity factor to the clipped gain factor produced by task T520 (e.g., by applying gain adjustment factor $f_1$ as described above to update the clipped factor). FIG. 8C shows a pseudocode listing that may be executed to perform task T520 according to the mapping shown in FIG. 8B. One of skill in the art will recognize that task T500 may also be implemented such that the sequence of tasks T520 and T530 is reversed (i.e., such that task T530 is performed on the initial value produced by task T510 and task T520 is performed on the result of task T530).

As noted herein, the audio signal processed by method M100 may be a residual of an LPC analysis of an input signal. As a result of the LPC analysis, the decoded output signal as produced by a corresponding LPC synthesis at the decoder may be louder or softer than the input signal. A set of coefficients produced by the LPC analysis of the input signal (e.g., a set of reflection coefficients or filter coefficients) may be used to calculate an LPC gain that generally indicates how much louder or softer the signal may be expected to become as it passes through the synthesis filter at the decoder.

In one example, the LPC gain is based on a set of reflection coefficients produced by the LPC analysis. In such case, the LPC gain may be calculated according to an expression such as $-10 \log_{10}\Pi_{i=1}^{p}(1-k_i^2)$, where $k_i$ is the i-th reflection coefficient and p is the order of the LPC analysis. In another example, the LPC gain is based on a set of filter coefficients produced by the LPC analysis. In such case, the LPC gain may be calculated as the energy of the impulse response of the LPC analysis filter (e.g., as described in section 4.6.1.2 (Generation of Spectral Transition Indicator (LPCFLAG), p. 4-40) of the document C.S0014-D v3.0 cited above, which section is hereby incorporated by reference as an example of an LPC gain calculation).

When the LPC gain increases, it may be expected that noise injected into the residual signal will also be amplified. Moreover, a high LPC gain typically indicates the signal is very correlated (e.g., tonal) rather than noise-like, and adding injected noise to the residual of such a signal may be inappropriate. In such a case, the input signal may be strongly tonal even if the spectrum appears non-sparse in the residual domain, such that a high LPC gain may be considered as an indication of tonality.

It may be desirable to implement task T500 to modulate the value of the noise injection gain factor according to the value of an LPC gain associated with the input audio spectrum. For example, it may be desirable to configure task T500 to reduce the value of the noise injection gain factor as the LPC gain increases. Such LPC-gain-based control of the noise injection gain factor, which may be performed in addition to or in the alternative to the low-gain clipping operation of task T520, may help to smooth out frame-to-frame variations in the LPC gain.

Figure 9A:
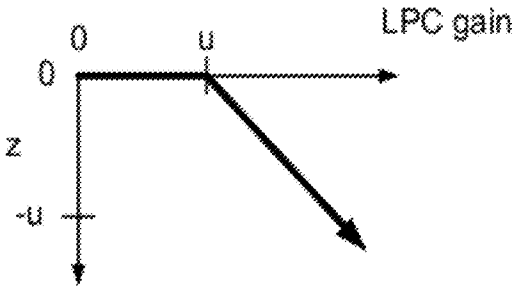
FIG. 9A shows an example of a mapping of an LPC gain value (in decibels) to a value of a factor z according to a monotonically decreasing function.
Figure 9B:
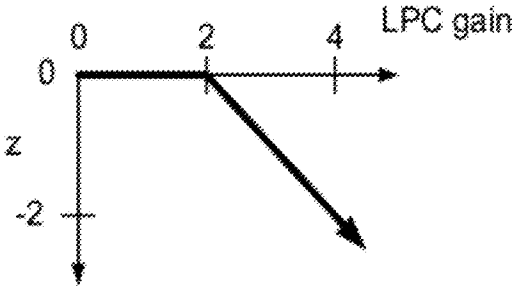
FIG. 9B shows a plot of the mapping of FIG. 9A for a particular threshold value.

FIG. 7B shows a flowchart of an implementation T504 of task T500 that includes subtasks T510, T530, and T540. Task T540 performs an adjustment, based on the LPC gain, to the modulated noise injection gain factor produced by task T530. FIG. 9A shows an example of a mapping of the LPC gain value $g_{LPC}$ (in decibels) to a value of a factor z according to a monotonically decreasing function. In this example, the factor z has a value of zero when the LPC gain is less than u and a value of $(2-g_{LPC})$ otherwise. In such case, task T540 may be implemented to adjust the noise injection gain factor produced by task T530 according to an expression such as $\gamma_{ni} \leftarrow 10^{z/20} \times \gamma_{ni}$. FIG. 9B shows a plot of such a mapping for the particular example in which the value of u is two.

Figure 9C:
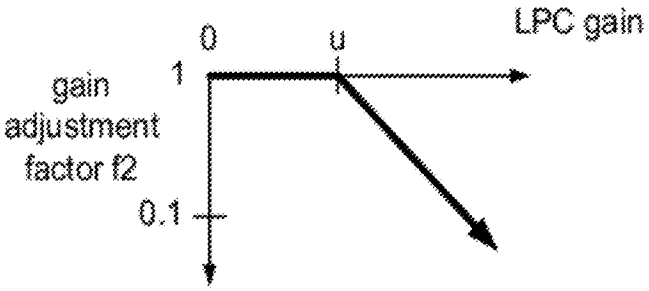
FIG. 9C shows an example of a different implementation of the mapping shown in FIG. 9A.
Figure 9D:
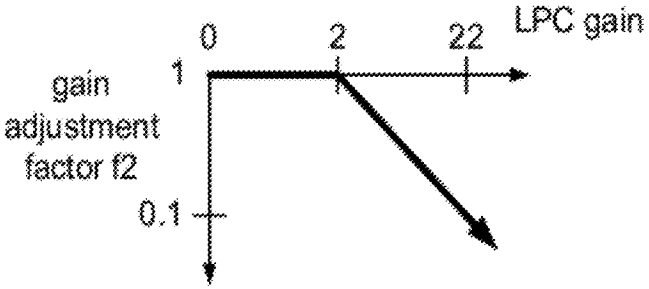
FIG. 9D shows a plot of the mapping of FIG. 9C for a particular threshold value.

FIG. 9C shows an example of a different implementation of the mapping shown in FIG. 9A in which the LPC gain value $g_{LPC}$ (in decibels) is mapped to a value of a gain adjustment factor $f_2$ according to a monotonically decreasing function, and FIG. 9D shows a plot of such a mapping for the particular example in which the value of u is two. The axes of the plots in FIGS. 9C and 9D are logarithmic. In such cases, task T540 may be implemented to adjust the noise injection gain factor produced by task T530 according to an expression such as $\gamma_{ni} \leftarrow f_2 \times \gamma_{ni}$, where the value of $f_2$ is $10^{(2-g_{LPC})/20}$ when the LPC gain is greater than two, and one otherwise. FIG. 8E shows a pseudocode listing that may be executed to perform task T540 according to a mapping as shown in FIGS. 9B and 9D. One of skill in the art will recognize that task T500 may also be implemented such that the sequence of tasks T530 and T540 is reversed (i.e., such that task T540 is performed on the initial value produced by task T510 and task T530 is performed on the result of task T540). FIG. 7C shows a flowchart of an implementation T506 of tasks T502 and T504 that includes subtasks T510, T520, T530, and T540. One of skill in the art will recognize that task T500 may also be implemented with tasks T520, T530, and/or T540 being performed in a different sequence (e.g., with task T540 being performed upstream of task T520 and/or T530, and/or with task T530 being performed upstream of task T520).

FIG. 10B shows a flowchart of a method M200 of noise injection according to a general configuration that includes subtasks TD100, TD200, and TD300. Such a method may be performed, for example, at a decoder. Task TD100 obtains (e.g., generates) a noise vector (e.g., a vector of independent and identically distributed (i.i.d.) Gaussian noise) of the same length as the number of empty elements in the input coded spectrum. It may be desirable to configure task TD100 to generate the noise vector according to a deterministic function, such that the same noise vector that is generated at the decoder may also be generated at the encoder (e.g., to support closed-loop analysis of the coded signal). For example, it may be desirable to implement task TD100 to generate the noise vector using a random number generator that is seeded with values from the encoded signal (e.g., with the codebook index generated by task T100).

Task TD100 may be configured to normalize the noise vector. For example, task TD100 may be configured to scale the noise vector to have a norm (i.e., sum of squares) equal to one. Task TD100 may also be configured to perform a spectral shaping operation on the noise vector according to a function (e.g., a spectral weighting function) which may be derived from either some side information (such as LPC parameters of the frame) or directly from the input coded spectrum. For example, task TD100 may be configured to apply a spectral shaping curve to a Gaussian noise vector, and to normalize the result to have unit energy.

It may be desirable to perform spectral shaping to maintain a desired spectral tilt of the noise vector. In one example, task TD100 is configured to perform the spectral shaping by applying a formant filter to the noise vector. Such an operation may tend to concentrate the noise more around the spectral peaks as indicated by the LPC filter coefficients, and not as much in the spectral valleys, which may be slightly preferable perceptually.

Task TD200 applies the dequantized noise injection gain factor to the noise vector. For example, task TD200 may be configured to dequantize the noise injection gain factor quantized by task T600 and to scale the noise vector produced by task TD100 by the dequantized noise injection gain factor.

Task TD300 injects the elements of the scaled noise vector produced by task TD200 into the corresponding empty elements of the input coded spectrum to produce the output coded, noise-injected spectrum. For example, task TD300 may be configured to dequantize one or more codebook indices (e.g., as produced by task T100) to obtain the input coded spectrum as a dequantized signal vector. In one example, task TD300 is implemented to begin at one end of the dequantized signal vector and at one end of the scaled noise vector and to traverse the dequantized signal vector, injecting the next element of the scaled noise vector at each zero-valued element that is encountered during the traverse of the dequantized signal vector. In another example, task TD300 is configured to calculate a zero-detection mask from the dequantized signal vector (e.g., as described herein with reference to task T200), to apply the mask to the scaled noise vector (e.g., as an element-by-element multiplication), and to add the resulting masked noise vector to the dequantized signal vector.

As noted above, noise injection methods (e.g., method M100 and M200) may be applied to encoding and decoding of pulse-coded signals. In general, however, such noise injection may be generally applied as a post-processing or back-end operation to any coding scheme that produces a coded result in which regions of the spectrum are set to zero. For example, such an implementation of method M100 (with a corresponding implementation of method M200) may be applied to the result of pulse-coding a residual of a dependent-mode or harmonic coding scheme as described herein, or to the output of such a dependent-mode or harmonic coding scheme in which the residual is set to zero.

Encoding of each frame of an audio signal typically includes dividing the frame into a plurality of subbands (i.e., dividing the frame as a vector into a plurality of subvectors), assigning a bit allocation to each subvector, and encoding each subvector into the corresponding allocated number of bits. It may be desirable in a typical audio coding application, for example, to perform vector quantization on a large number of (e.g., ten, twenty, thirty, or forty) different subband vectors for each frame. Examples of frame size include (without limitation) 100, 120, 140, 160, and 180 values (e.g., transform coefficients), and examples of subband length include (without limitation) five, six, seven, eight, nine, ten, eleven, twelve, and sixteen.

An audio encoder that includes an implementation of apparatus A100, or that is otherwise configured to perform method M100, may be configured to receive frames of an audio signal (e.g., an LPC residual) as samples in a transform domain (e.g., as transform coefficients, such as MDCT coefficients or FFT coefficients). Such an encoder may be implemented to encode each frame by grouping the transform coefficients into a set of subvectors according to a predetermined division scheme (i.e., a fixed division scheme that is known to the decoder before the frame is received) and encoding each subvector using a gain-shape vector quantization scheme. The subvectors may but need not overlap and may even be separated from one another (in the particular examples described herein, the subvectors do not overlap, except for an overlap as described between a 0-4-kHz lowband and a 3.5-7-kHz highband). This division may be predetermined (e.g., independent of the contents of the vector), such that each input vector is divided the same way.

In one example of such a predetermined division scheme, each 100-element input vector is divided into three subvectors of respective lengths (25, 35, 40). Another example of a predetermined division divides an input vector of 140 elements into a set of twenty subvectors of length seven. A further example of a predetermined division divides an input vector of 280 elements into a set of forty subvectors of length seven. In such cases, apparatus A100 or method M100 may be configured to receive each of two or more of the subvectors as a separate input signal vector and to calculate a separate noise injection gain factor for each of these subvectors. Multiple implementations of apparatus A100 or method M100 arranged to process different subvectors at the same time are also contemplated.

Low-bit-rate coding of audio signals often demands an optimal utilization of the bits available to code the contents of the audio signal frame. It may be desirable to identify regions of significant energy within a signal to be encoded. Separating such regions from the rest of the signal enables targeted coding of these regions for increased coding efficiency. For example, it may be desirable to increase coding efficiency by using relatively more bits to encode such regions and relatively fewer bits (or even no bits) to encode other regions of the signal. In such cases, it may be desirable to perform method M100 on these other regions, as their coded spectra will typically include a significant number of zero-valued elements.

Figure 11:
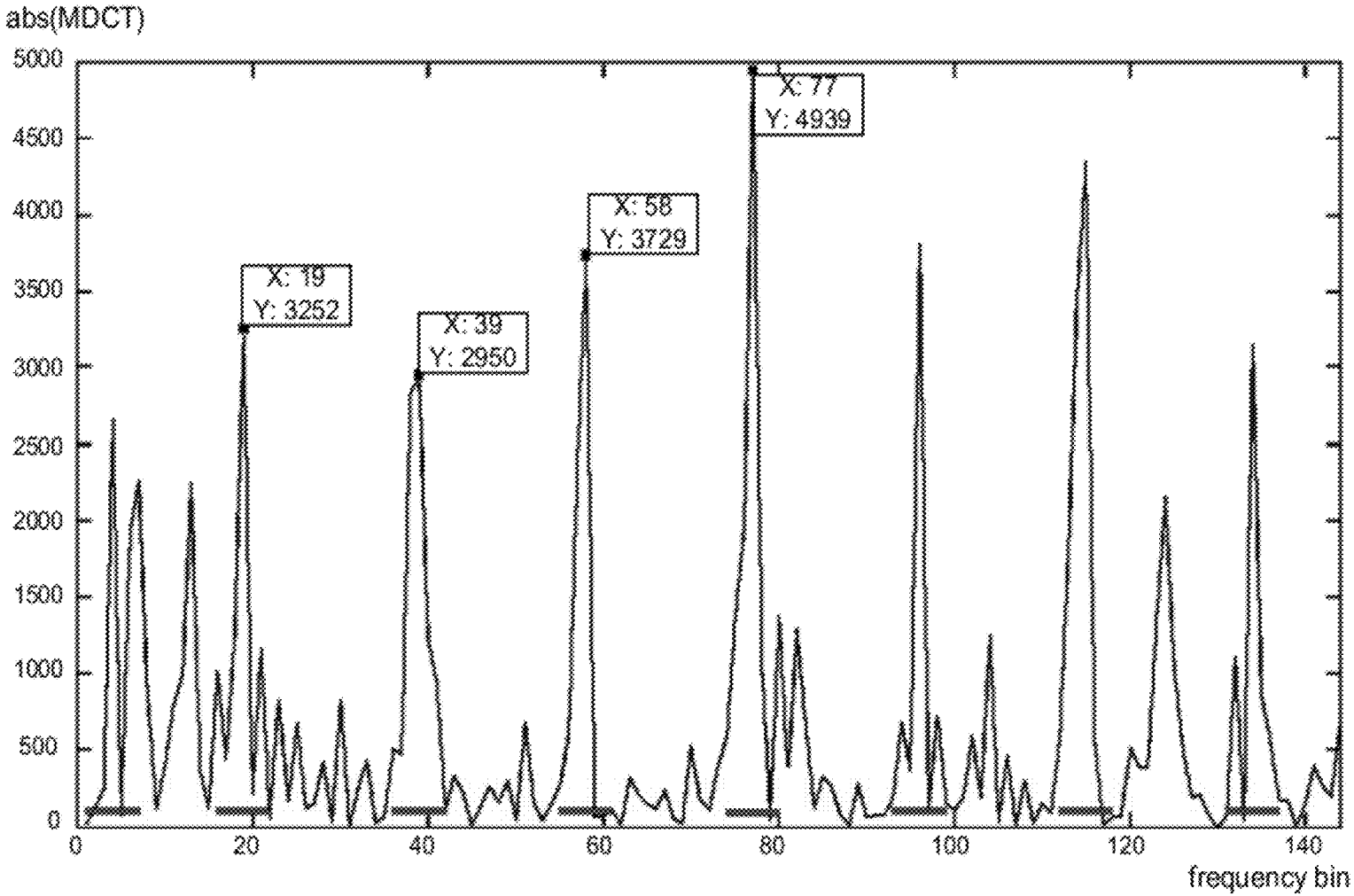
FIG. 11 shows an example of selected subbands in a low-band audio signal.
Figure 12:
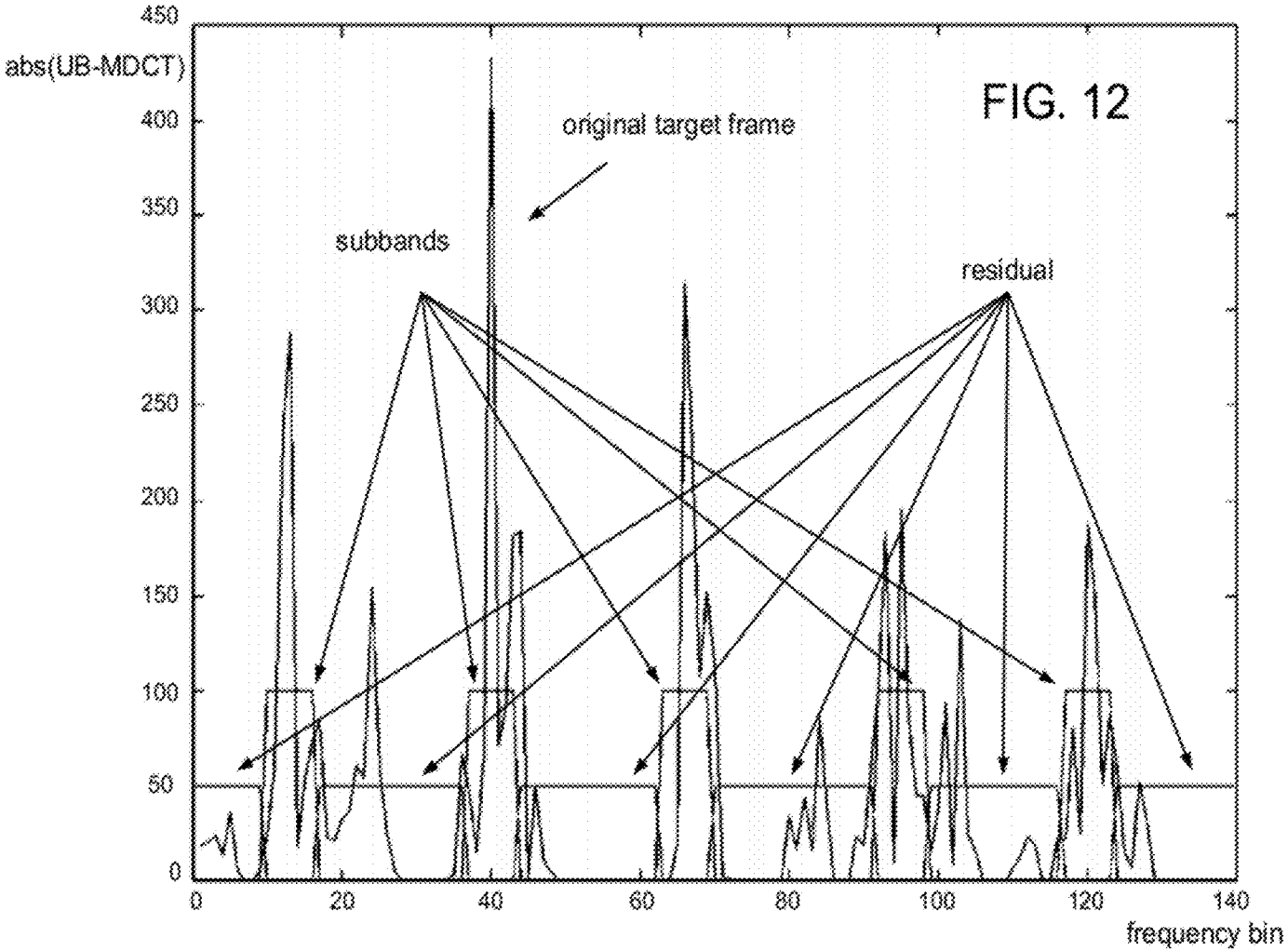
FIG. 12 shows an example of selected subbands and residual components in a highband audio signal.

Alternatively, this division may be variable, such that the input vectors are divided differently from one frame to the next (e.g., according to some perceptual criteria). It may be desirable, for example, to perform efficient transform domain coding of an audio signal by detection and targeted coding of harmonic components of the signal. FIG. 11 shows a plot of magnitude vs. frequency in which eight selected subbands of length seven that correspond to harmonically spaced peaks of a lowband linear prediction coding (LPC) residual signal are indicated by bars near the frequency axis. In such case, the locations of the selected subbands may be modeled using two values: a first selected value to represent the fundamental frequency F0, and a second selected value to represent the spacing between adjacent peaks in the frequency domain. FIG. 12 shows a similar example for a highband LPC residual signal that indicates the residual components that lie between and outside of the selected subbands. In such cases, it may be desirable to perform method M100 on the residual components (e.g., separately on each residual component and/or on a concatenation of two or more, and possibly all, of the residual components). Additional description of harmonic modeling and harmonic-mode coding (including cases in which the locations of peaks in a highband region of a frame are modeled based on locations of peaks in a coded version of a lowband region of the same frame) may be found in the applications listed above to which this application claims priority.

Another example of a variable division scheme identifies a set of perceptually important subbands in the current frame (also called the target frame) based on the locations of perceptually important subbands in a coded version of another frame (also called the reference frame), which may be the previous frame. FIG. 10A shows an example of a subband selection operation in such a coding scheme. For audio signals having high harmonic content (e.g., music signals, voiced speech signals), the locations of regions of significant energy in the frequency domain at a given time may be relatively persistent over time. It may be desirable to perform efficient transform-domain coding of an audio signal by exploiting such a correlation over time. In one such example, a dynamic subband selection scheme is used to match perceptually important (e.g., high-energy) subbands of a frame to be encoded with corresponding perceptually important subbands of the previous frame as decoded (also called "dependent-mode coding"). In such cases, it may be desirable to perform method M100 on the residual components that lie between and outside of the selected subbands (e.g., separately on each residual component and/or on a concatenation of two or more, and possibly all, of the residual components). In a particular application, such a scheme is used to encode MDCT transform coefficients corresponding to the 0-4 kHz range of an audio signal, such as a residual of a linear prediction coding (LPC) operation. Additional description of dependent-mode coding may be found in the applications listed above to which this application claims priority.

Another example of a residual signal is obtained by coding a set of selected subbands (e.g., as selected according to any of the dynamic selection schemes described above) and subtracting the coded set from the original signal. In such case, it may be desirable to perform method M100 on all or part of the residual signal. For example, it may be desirable to perform method M100 on the entire residual signal vector or to perform method M100 separately on each of one or more subvectors of the residual signal, which may be divided into subvectors according to a predetermined division scheme.

Figure 13B:
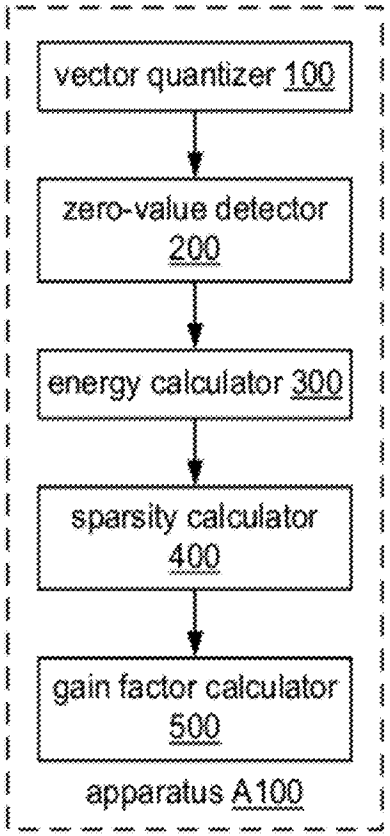
FIG. 13B shows a block diagram of an apparatus for processing an audio signal A100 according to another general configuration.
Figure 13A:
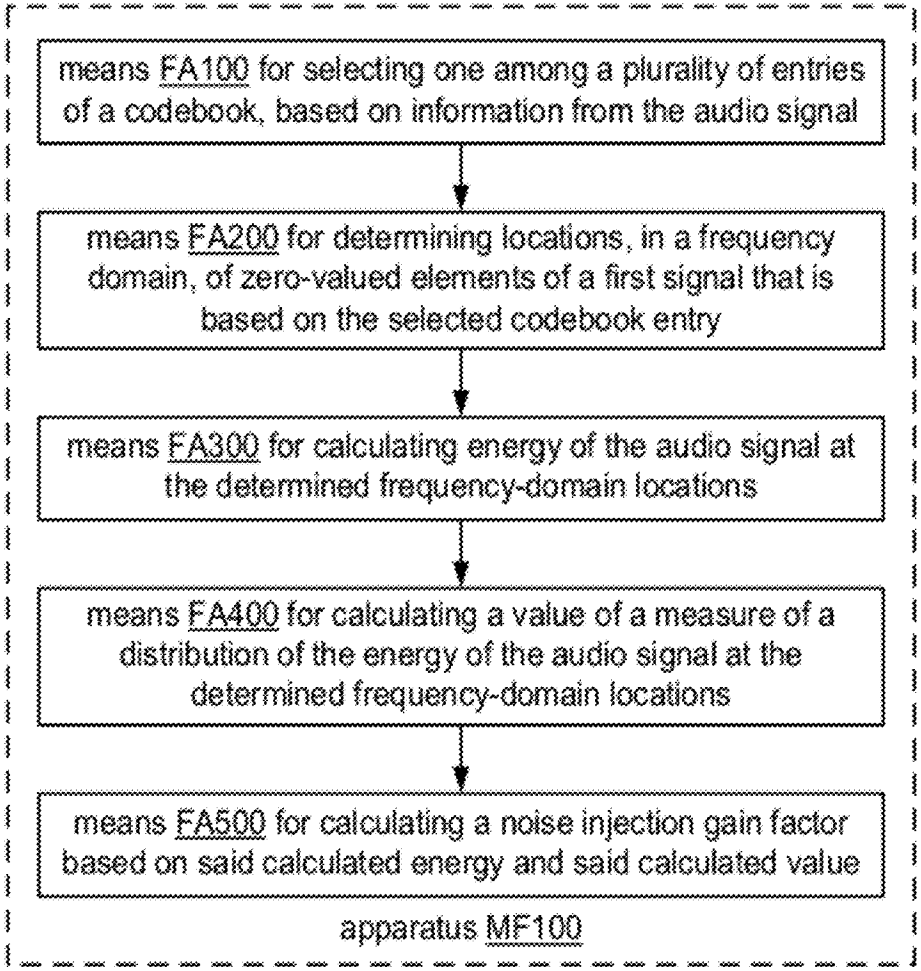
FIG. 13A shows a block diagram of an apparatus for processing an audio signal MF100 according to a general configuration.

FIG. 13A shows a block diagram of an apparatus for processing an audio signal MF100 according to a general configuration. Apparatus MF100 includes means FA100 for selecting one among a plurality of entries of a codebook, based on information from the audio signal (e.g., as described herein with reference to implementations of task T100). Apparatus MF100 also includes means FA200 for determining locations, in a frequency domain, of zero-valued elements of a first signal that is based on the selected codebook entry (e.g., as described herein with reference to implementations of task T200). Apparatus MF100 also includes means FA300 for calculating energy of the audio signal at the determined frequency-domain locations (e.g., as described herein with reference to implementations of task T300). Apparatus MF100 also includes means FA400 for calculating a value of a measure of a distribution of the energy of the audio signal at the determined frequency-domain locations (e.g., as described herein with reference to implementations of task T400). Apparatus MF100 also includes means FA500 for calculating a noise injection gain factor based on said calculated energy and said calculated value (e.g., as described herein with reference to implementations of task T500).

FIG. 13B shows a block diagram of an apparatus for processing an audio signal A100 according to a general configuration that includes a vector quantizer 100, a zero-value detector 200, an energy calculator 300, a sparsity calculator 400, and a gain factor calculator 500. Vector quantizer 100 is configured to select one among a plurality of entries of a codebook, based on information from the audio signal (e.g., as described herein with reference to implementations of task T100). Zero-value detector 200 is configured to determine locations, in a frequency domain, of zero-valued elements of a first signal that is based on the selected codebook entry (e.g., as described herein with reference to implementations of task T200). Energy calculator 300 is configured to calculate energy of the audio signal at the determined frequency-domain locations (e.g., as described herein with reference to implementations of task T300). Sparsity calculator 400 is configured to calculate a value of a measure of a distribution of the energy of the audio signal at the determined frequency-domain locations (e.g., as described herein with reference to implementations of task T400). Gain factor calculator 500 is configured to calculate a noise injection gain factor based on said calculated energy and said calculated value (e.g., as described herein with reference to implementations of task T500). Apparatus A100 may also be implemented to include a scalar quantizer configured to quantize the noise injection gain factor produced by gain factor calculator 500 (e.g., as described herein with reference to implementations of task T600).

FIG. 10C shows a block diagram of an apparatus for noise injection MF200 according to a general configuration. Apparatus MF200 includes means FD100 for obtaining a noise vector (e.g., as described herein with reference to task TD100). Apparatus MF200 also includes means FD200 for applying a dequantized noise injection gain factor to the noise vector (e.g., as described herein with reference to task TD200). Apparatus MF200 also includes means FD300 for injecting the scaled noise vector at empty elements of a coded spectrum (e.g., as described herein with reference to task TD300).

FIG. 10D shows a block diagram of an apparatus for noise injection A200 according to a general configuration that includes a noise generator D100, a scaler D200, and a noise injector D300. Noise generator D100 is configured to obtain a noise vector (e.g., as described herein with reference to task TD100). Scaler D200 is configured to apply a dequantized noise injection gain factor to the noise vector (e.g., as described herein with reference to task TD200). For example, scaler D200 may be configured to multiply each element of the noise vector by the dequantized noise injection gain factor. Noise injector D300 is configured to inject the scaled noise vector at empty elements of a coded spectrum (e.g., as described herein with reference to implementations of task TD300). In one example, noise injector D300 is implemented to begin at one end of a dequantized signal vector and at one end of the scaled noise vector and to traverse the dequantized signal vector, injecting the next element of the scaled noise vector at each zero-valued element that is encountered during the traverse of the dequantized signal vector. In another example, noise injector D300 is configured to calculate a zero-detection mask from the dequantized signal vector (e.g., as described herein with reference to task T200), to apply the mask to the scaled noise vector (e.g., as an element-by-element multiplication), and to add the resulting masked noise vector to the dequantized signal vector.

Figure 14:
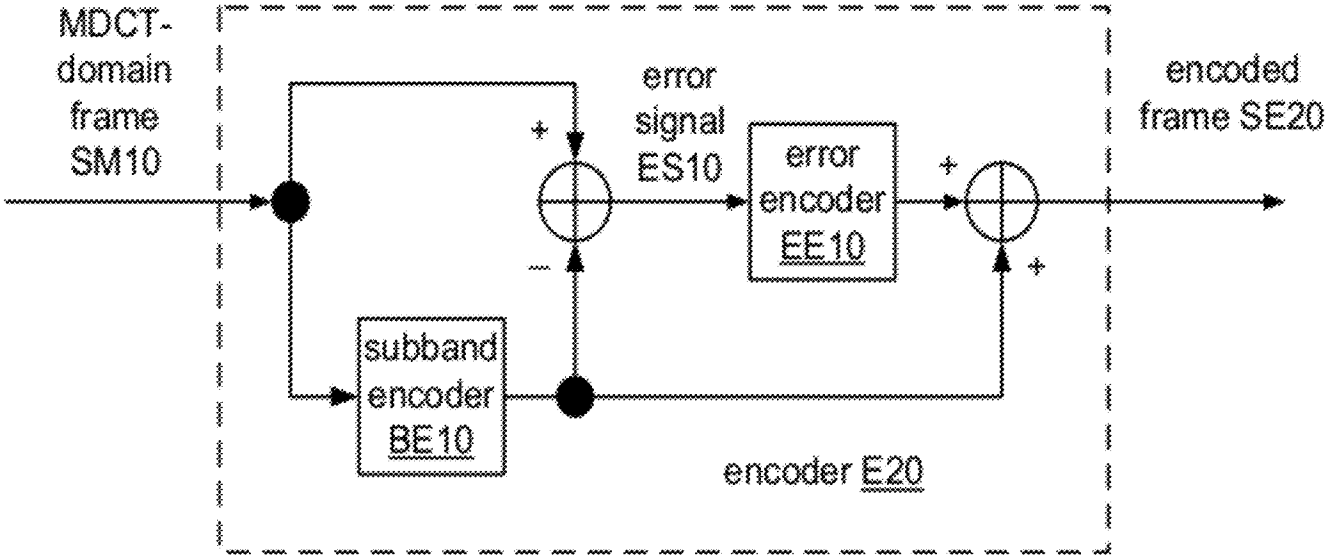
FIG. 14 shows a block diagram of an encoder E20.

FIG. 14 shows a block diagram of an encoder E20 that is configured to receive an audio frame SM10 as samples in the MDCT domain (i.e., as transform domain coefficients) and to produce a corresponding encoded frame SE20. Encoder E20 includes a subband encoder BE10 that is configured to encode a plurality of subbands of the frame (e.g., according to a VQ scheme, such as GSVQ). The coded subbands are subtracted from the input frame to produce an error signal ES10 (also called a residual), which is encoded by error encoder EE10. Error encoder EE10 may be configured to encode error signal ES10 using a pulse-coding scheme as described herein, and to perform an implementation of method M100 as described herein to calculate a noise injection gain factor. The coded subbands and coded error signal (including a representation of the calculated noise injection gain factor) are combined to obtain the encoded frame SE20.

Figure 15:
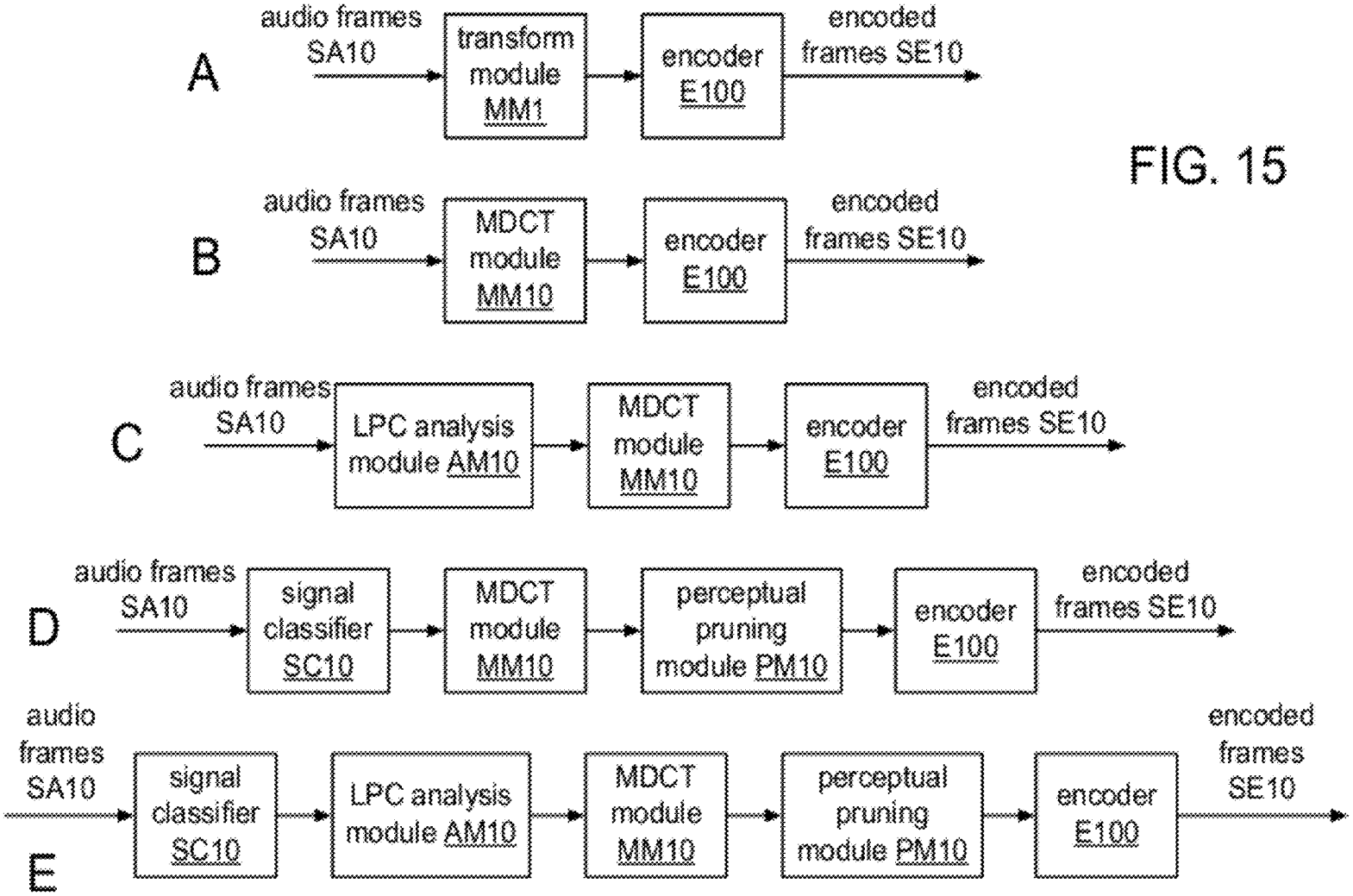
FIGS. 15A-E show a range of applications for an encoder E100.

FIGS. 15A-E show a range of applications for an encoder E100 that is implemented to encode a signal in a transform domain (e.g., by performing any of the encoding schemes described herein, such as a harmonic coding scheme or a dependent-mode coding scheme, or as an implementation of encoder E20) and is also configured to perform an instance of method M100 as described herein. FIG. 15A shows a block diagram of an audio processing path that includes a transform module MM1 (e.g., a fast Fourier transform or MDCT module) and an instance of encoder E100 that is arranged to receive the audio frames SA10 as samples in the transform domain (i.e., as transform domain coefficients) and to produce corresponding encoded frames SE10.

FIG. 15B shows a block diagram of an implementation of the path of FIG. 15A in which transform module MM1 is implemented using an MDCT transform module. Modified DCT module MM10 performs an MDCT operation as described herein on each audio frame to produce a set of MDCT domain coefficients.

FIG. 15C shows a block diagram of an implementation of the path of FIG. 15A that includes a linear prediction coding analysis module AM10. Linear prediction coding (LPC) analysis module AM10 performs an LPC analysis operation on the classified frame to produce a set of LPC parameters (e.g., filter coefficients) and an LPC residual signal. In one example, LPC analysis module AM10 is configured to perform a tenth-order LPC analysis on a frame having a bandwidth of from zero to 4000 Hz. In another example, LPC analysis module AM10 is configured to perform a sixth-order LPC analysis on a frame that represents a highband frequency range of from 3500 to 7000 Hz. Modified DCT module MM10 performs an MDCT operation on the LPC residual signal to produce a set of transform domain coefficients. A corresponding decoding path may be configured to decode encoded frames SE10 and to perform an inverse MDCT transform on the decoded frames to obtain an excitation signal for input to an LPC synthesis filter.

FIG. 15D shows a block diagram of a processing path that includes a signal classifier SC10. Signal classifier SC10 receives frames SA10 of an audio signal and classifies each frame into one of at least two categories. For example, signal classifier SC10 may be configured to classify a frame SA10 as speech or music, such that if the frame is classified as music, then the rest of the path shown in FIG. 15D is used to encode it, and if the frame is classified as speech, then a different processing path is used to encode it. Such classification may include signal activity detection, noise detection, periodicity detection, time-domain sparseness detection, and/or frequency-domain sparseness detection.

Figure 16A:
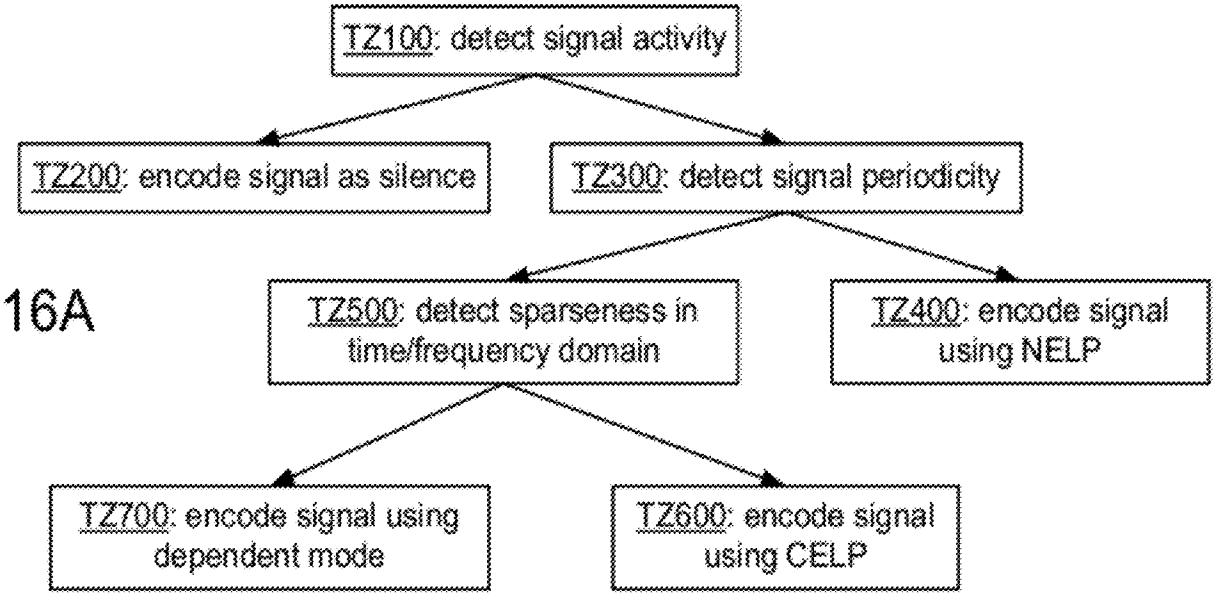
FIG. 16A shows a block diagram of a method MZ100 of signal classification.

FIG. 16A shows a block diagram of a method MZ100 of signal classification that may be performed by signal classifier SC10 (e.g., on each of the audio frames SA10). Method MC100 includes tasks TZ100, TZ200, TZ300, TZ400, TZ500, and TZ600. Task TZ100 quantifies a level of activity in the signal. If the level of activity is below a threshold, task TZ200 encodes the signal as silence (e.g., using a low-bit-rate noise-excited linear prediction (NELP) scheme and/or a discontinuous transmission (DTX) scheme). If the level of activity is sufficiently high (e.g., above the threshold), task TZ300 quantifies a degree of periodicity of the signal. If task TZ300 determines that the signal is not periodic, task TZ400 encodes the signal using a NELP scheme. If task TZ300 determines that the signal is periodic, task TZ500 quantifies a degree of sparsity of the signal in the time and/or frequency domain. If task TZ500 determines that the signal is sparse in the time domain, task TZ600 encodes the signal using a code-excited linear prediction (CELP) scheme, such as relaxed CELP (RCELP) or algebraic CELP (ACELP). If task TZ500 determines that the signal is sparse in the frequency domain, task TZ700 encodes the signal using a harmonic model, a dependent mode, or a scheme as described with reference to encoder E20 (e.g., by passing the signal to the rest of the processing path in FIG. 15D).

As shown in FIG. 15D, the processing path may include a perceptual pruning module PM10 that is configured to simplify the MDCT-domain signal (e.g., to reduce the number of transform domain coefficients to be encoded) by applying psychoacoustic criteria such as time masking, frequency masking, and/or hearing threshold. Module PM10 may be implemented to compute the values for such criteria by applying a perceptual model to the original audio frames SA10. In this example, encoder E100 is arranged to encode the pruned frames to produce corresponding encoded frames SE10.

FIG. 15E shows a block diagram of an implementation of both of the paths of FIGS. 15C and 15D, in which encoder E100 is arranged to encode the LPC residual.

Figure 16B:
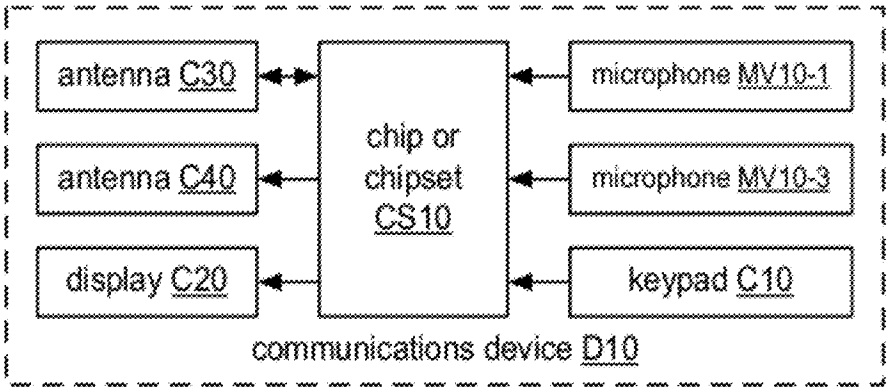
FIG. 16B shows a block diagram of a communications device D10.

FIG. 16B shows a block diagram of a communications device D10 that includes an implementation of apparatus A100. Device D10 includes a chip or chipset CS10 (e.g., a mobile station modem (MSM) chipset) that embodies the elements of apparatus A100 (or MF100) and possibly of apparatus A200 (or MF200). Chip/chipset CS10 may include one or more processors, which may be configured to execute a software and/or firmware part of apparatus A100 or MF100 (e.g., as instructions).

Chip/chipset CS10 includes a receiver, which is configured to receive a radio-frequency (RF) communications signal and to decode and reproduce an audio signal encoded within the RF signal, and a transmitter, which is configured to transmit an RF communications signal that describes an encoded audio signal (e.g., including a representation of a noise injection gain factor as produced by apparatus A100) that is based on a signal produced by microphone MV10. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). For example, chip or chipset CS10 may be configured to produce the encoded frames to be compliant with one or more such codecs.

Device D10 is configured to receive and transmit the RF communications signals via an antenna C30. Device D10 may also include a diplexer and one or more power amplifiers in the path to antenna C30. Chip/chipset CS10 is also configured to receive user input via keypad C10 and to display information via display C20. In this example, device D10 also includes one or more antennas C40 to support Global Positioning System (GPS) location services and/or short-range communications with an external device such as a wireless (e.g., Bluetooth™) headset. In another example, such a communications device is itself a Bluetooth™ headset and lacks keypad C10, display C20, and antenna C30.

Figure 17:
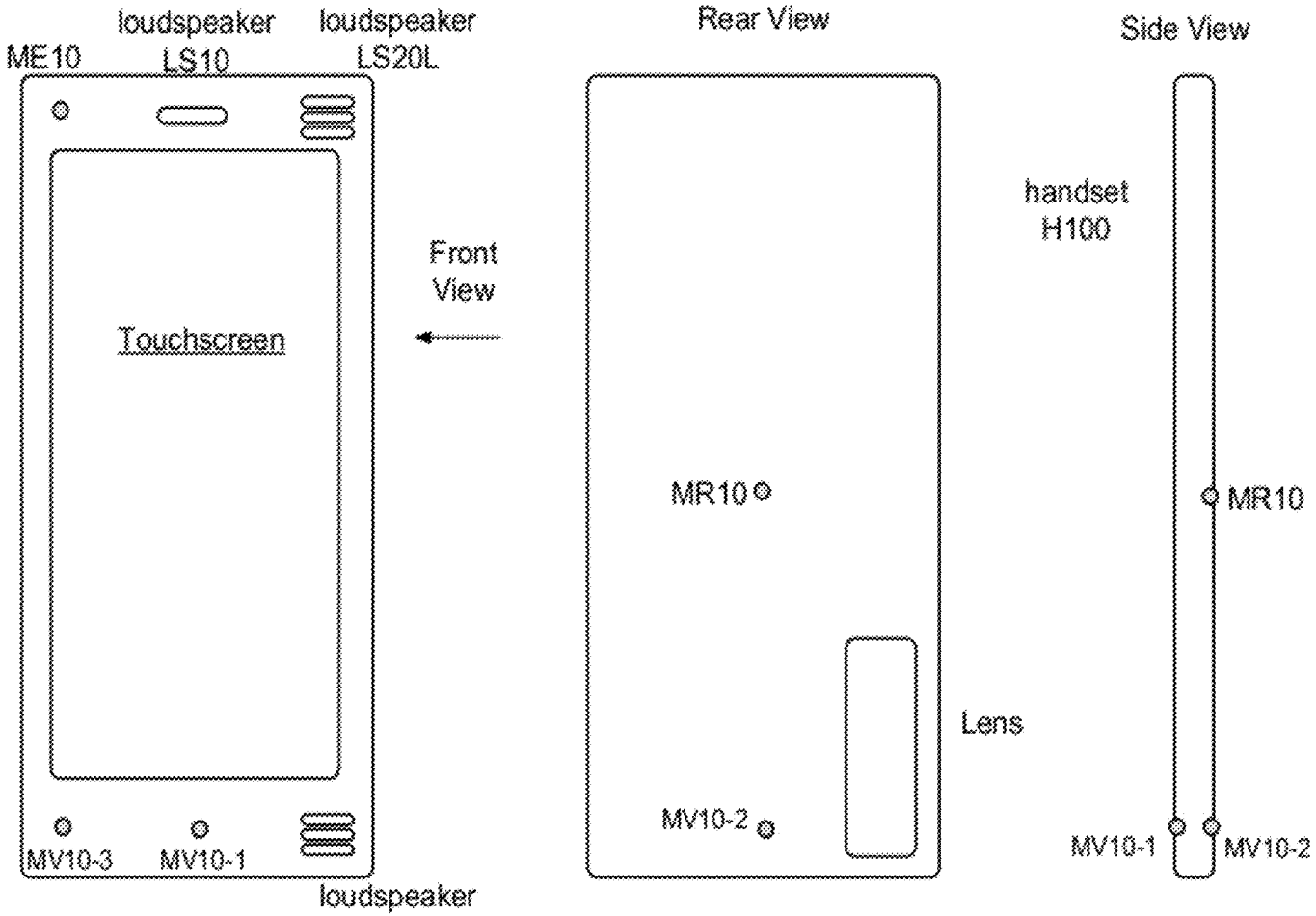
FIG. 17 shows front, rear, and side views of a handset H100.

Communications device D10 may be embodied in a variety of communications devices, including smartphones and laptop and tablet computers. FIG. 17 shows front, rear, and side views of a handset H100 (e.g., a smartphone) having two voice microphones MV10-1 and MV10-3 arranged on the front face, a voice microphone MV10-2 arranged on the rear face, an error microphone ME10 located in a top corner of the front face, and a noise reference microphone MR10 located on the back face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

An apparatus as disclosed herein (e.g., apparatus A100 and MF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100 and MF100) may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 or MF200, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., implementations of methods M100 and MF200) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The invention claimed is:

1. A method of processing an audio signal, the method being performed by an audio coding apparatus, said method comprising:

based on information from the audio signal, selecting one among a plurality of entries of a codebook;

determining, by the audio coding apparatus, locations, in a frequency domain, of zero-valued elements of a first signal that is based on the selected codebook entry;

calculating, by the audio coding apparatus, based on elements of the audio signal which are located at the determined frequency-domain locations, a first energy;

calculating, by the audio coding apparatus, an energy distribution value of the audio signal; and based on the calculated first energy and the calculated energy distribution value, calculating, by the audio coding apparatus, a noise injection gain factor.

2. The method according to claim 1, wherein said selected codebook entry is based on a pattern of unit pulses.

3. The method according to claim 1, wherein said calculating an energy distribution value of the audio signal includes:

calculating for each of the elements, an energy; and sorting the energies calculated for the elements.

4. The method according to claim 1, wherein said energy distribution value is based on a relation between (A) a total energy of a subset of the elements and (B) a total energy of the elements.

5. The method according to claim 1, wherein said noise injection gain factor is based on a relation between (A) the calculated first energy and (B) an energy of the audio signal in a frequency range that includes the determined frequency-domain locations.

6. The method according to claim 1, wherein said calculating the noise injection gain factor includes:

detecting that an initial value of the noise injection gain factor is not greater than a threshold value; and clipping the initial value of the noise injection gain factor in response to said detecting.

7. The method according to claim 6, wherein said noise injection gain factor is based on a result of applying the calculated energy distribution value to the clipped value.

8. The method according to claim 1, wherein said audio signal is a plurality of modified discrete cosine transform coefficients.

9. The method according to claim 1, wherein said audio signal is based on a residual of a linear prediction coding analysis of a second audio signal.

10. The method according to claim 9, wherein said noise injection gain factor is also based on a linear prediction coding gain, and wherein said linear prediction coding gain is based on a set of coefficients produced by said linear prediction coding analysis of the second audio signal.

11. An audio coding apparatus for processing an audio signal, said audio coding apparatus comprising:

means for selecting, by the audio coding apparatus, one among a plurality of entries of a codebook, based on information from the audio signal;

means for determining, by the audio coding apparatus, locations, in a frequency domain, of zero-valued elements of a first signal that is based on the selected codebook entry;

means for calculating, by the audio coding apparatus, based on elements of the audio signal which are located at the determined frequency-domain locations, a first energy;

means for calculating, by the audio coding apparatus, an energy distribution value of the audio signal; and means for calculating, by the audio coding apparatus, a noise injection gain factor based on the calculated first energy and the calculated energy distribution value.

12. The audio coding apparatus according to claim 11, wherein said selected codebook entry is based on a pattern of unit pulses.

13. The audio coding apparatus according to claim 11, wherein said means for calculating an energy distribution value of the audio signal includes:

means for calculating for each of the elements an energy; and means for sorting the energies calculated for the elements.

14. The audio coding apparatus according to claim 11, wherein said energy distribution value is based on a relation between (A) a total energy of a subset of the elements and (B) a total energy of the elements.

15. The audio coding apparatus according to claim 11, wherein said noise injection gain factor is based on a relation between (A) the calculated first energy and (B) an energy of the audio signal in a frequency range that includes the determined frequency-domain locations.

16. The audio coding apparatus according to claim 11, wherein said means for calculating the noise injection gain factor includes:

means for detecting that an initial value of the noise injection gain factor is not greater than a threshold value; and means for clipping the initial value of the noise injection gain factor in response to said detecting.

17. The audio coding apparatus according to claim 16, wherein said noise injection gain factor is based on a result of applying the calculated energy distribution value to the clipped value.

18. The audio coding apparatus according to claim 11, wherein said audio signal is a plurality of modified discrete cosine transform coefficients.

19. The audio coding apparatus according to claim 11, wherein said audio signal is based on a residual of a linear prediction coding analysis of a second audio signal.

20. The audio coding apparatus according to claim 19, wherein said noise injection gain factor is also based on a linear prediction coding gain, and wherein said linear prediction coding gain is based on a set of coefficients produced by said linear prediction coding analysis of the second audio signal.

21. An audio coding apparatus for processing an audio signal, said audio coding apparatus comprising:

a processor;

memory in electronic communication with the processor; and instructions stored in the memory, the instructions being executable by the processor to:

select, by the audio coding apparatus, one among a plurality of entries of a codebook, based on information from the audio signal;

determine, by the audio coding apparatus, locations, in a frequency domain, of zero-valued elements of a first signal that is based on the selected codebook entry;

calculate, by the audio coding apparatus, based on elements of the audio signal which are located at the determined frequency-domain locations, a first energy;

calculate, by the audio coding apparatus, an energy distribution value of the audio signal; and calculate, by the audio coding apparatus, a noise injection gain factor based on the calculated first energy and the calculated energy distribution value.

22. The audio coding apparatus according to claim 21, wherein said selected codebook entry is based on a pattern of unit pulses.

23. The audio coding apparatus according to claim 21, wherein said calculating an energy distribution value of the audio signal comprises calculating for each of the elements an energy and sorting the energies calculated for the elements.

24. The audio coding apparatus according to claim 21, wherein said energy distribution value is based on a relation between (A) a total energy of a subset of the elements and (B) a total energy of the elements.

25. The audio coding apparatus according to claim 21, wherein said noise injection gain factor is based on a relation between (A) the calculated first energy and (B) an energy of the audio signal in a frequency range that includes the determined frequency-domain locations.

26. The audio coding apparatus according to claim 21, wherein said calculating the noise injection gain factor comprises detecting that an initial value of the noise injection gain factor is not greater than a threshold value and clipping the initial value of the noise injection gain factor in response to said detecting.

27. The audio coding apparatus according to claim 26, wherein said noise injection gain factor is based on a result of applying the calculated energy distribution value to the clipped value.

28. The audio coding apparatus according to claim 21, wherein said audio signal is a plurality of modified discrete cosine transform coefficients.

29. The audio coding apparatus according to claim 21, wherein said audio signal is based on a residual of a linear prediction coding analysis of a second audio signal.

30. The audio coding apparatus according to claim 29, wherein said noise injection gain factor is also based on a linear prediction coding gain, and wherein said linear prediction coding gain is based on a set of coefficients produced by said linear prediction coding analysis of the second audio signal.

31. A non-transitory computer-readable storage medium having tangible features that cause an audio coding apparatus reading the features to:

select, by the audio coding apparatus, one among a plurality of entries of a codebook, based on information from the audio signal;

determine, by the audio coding apparatus, locations, in a frequency domain, of zero-valued elements of a first signal that is based on the selected codebook entry;

calculate, by the audio coding apparatus, based on elements of the audio signal which are located at the determined frequency-domain locations, a first energy;

calculate, by the audio coding apparatus, an energy distribution value of the audio signal; and calculate, by the audio coding apparatus, a noise injection gain factor based on the calculated first energy and the calculated energy distribution value.

* * * * *